United States Patent [19]

Horino

[11] 4,025,420

[45] May 24, 1977

[54] THIN-SHEET-SORTING APPARATUS

[75] Inventor: Shigeo Horino, Tokyo, Japan

[73] Assignee: Tokyo Shibaura Electric Co., Ltd., Kawasaki, Japan

[22] Filed: Sept. 24, 1974

[21] Appl. No.: 508,908

[30] Foreign Application Priority Data

Sept. 28, 1973 Japan ..... 48-109017

[52] U.S. Cl. ..... 209/74 R; 209/111.7 T; 53/59 R; 250/562; 194/DIG. 26

[51] Int. Cl.² ..... B07C 5/10; G65H 7/12

[58] Field of Search ..... 209/DIG. 2, 111.6, 111.7, 209/74 R, 111.7 T; 194/DIG. 9 B, DIG. 26; 53/59 R, 198 R; 250/562, 563, 572

[56] References Cited

UNITED STATES PATENTS

| | | | |
|---|---|---|---|
| 3,105,151 | 9/1963 | Nash | 250/562 |
| 3,343,672 | 9/1967 | De Vries et al. | 209/74 R |
| 3,352,417 | 11/1967 | Cutaia | 209/74 R |
| 3,412,993 | 11/1968 | Giori | 209/111.7 |
| 3,426,879 | 2/1969 | Walker | 209/111.7 X |
| 3,487,905 | 1/1970 | James | 194/DIG. 26 |
| 3,496,370 | 2/1970 | Haville et al. | 209/111.7 T X |
| 3,710,936 | 1/1963 | Mizunuma | 209/111.7 X |
| 3,759,382 | 9/1973 | Walkley | 209/DIG. 2 |
| 3,782,543 | 1/1974 | Martelli | 209/DIG. 2 |
| 3,874,653 | 4/1975 | Welch et al. | 209/74 R X |
| 3,938,663 | 2/1976 | Carnes et al. | 209/73 |

*Primary Examiner*—Robert B. Reeves
*Assistant Examiner*—Joseph J. Rolla
*Attorney, Agent, or Firm*—Oblon, Fisher, Spivak, McClelland & Maier

[57] ABSTRACT

A thin sheet-sorting apparatus, wherein straps fastening bundles of, for example, one hundred bank notes are taken off and put in a sorting card-issuing device, which in turn impresses prescribed data associated with the bundles of bank notes on the straps and also digital data representing the impressed information on sorting cards; for each lot of, for example, one thousand bank notes the bank notes are stacked in batches of 100 together with the corresponding sorting cards in the feed section of the sorting apparatus; the bank notes and sorting cards are separated in the first sorting device into a first group consisting of fit bank notes including damaged ones and a second group consisting of unit bank notes and sorting cards; counting is made of both groups to ascertain whether the total number of the fit bank notes including the slightly damaged or unsoiled ones still available for recirculation and the unfit bank notes for each of the batches was a prescribed number, i.e. 100 or whether the coincidence between the total number of the sheets of each batch set in said feed section and that of the sheets of the first and second groups was obtained; straps fastening the bundles of bank notes in which unfit bank notes were found are taken out to read out the items of data impressed on said straps, for example, the names of persons who initially strapped such defective bundles of bank notes.

15 Claims, 22 Drawing Figures

FIG. 4
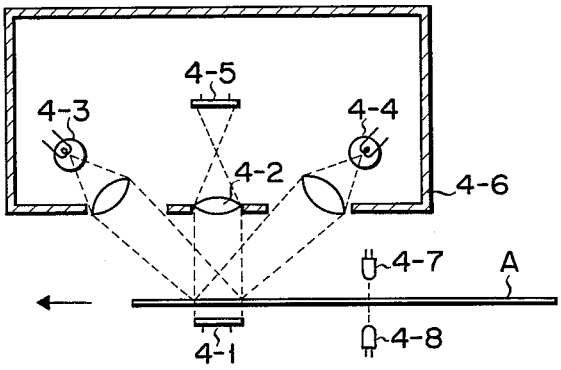
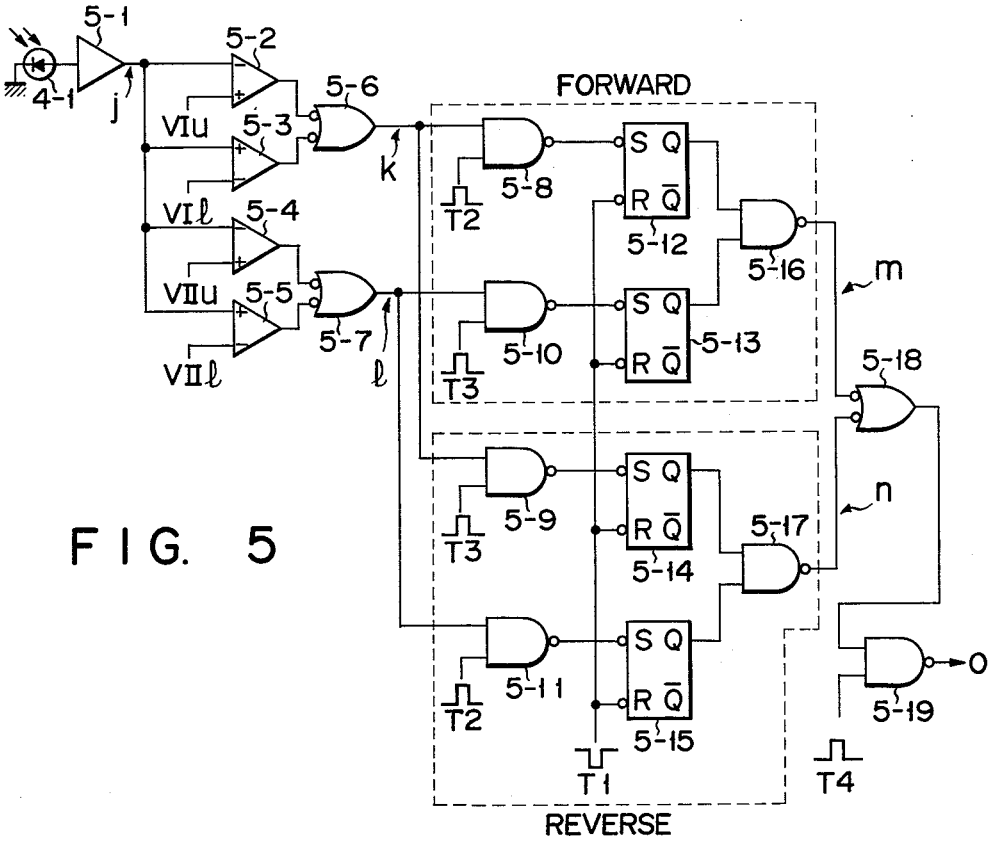
FIG. 5

FIG. 6
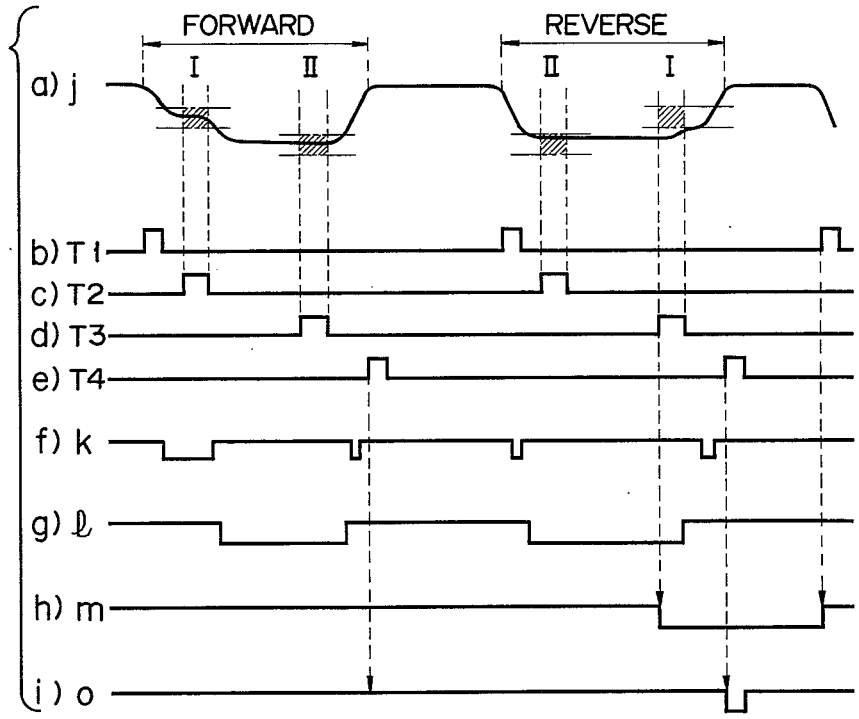
FIG. 7
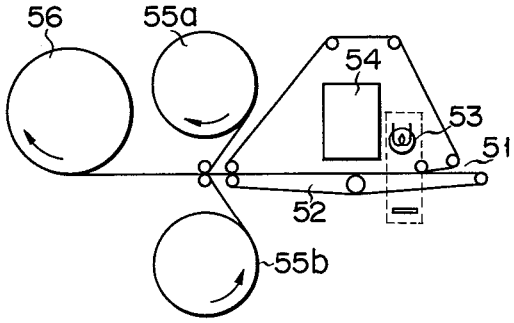
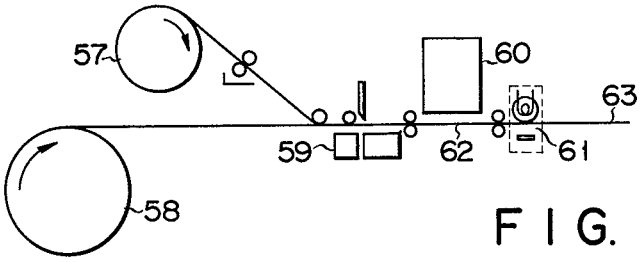
FIG. 8

THIN-SHEET-SORTING APPARATUS

This invention relates to an apparatus for automatically sorting thin sheets such as bills and bank notes according to the object intended.

In recent years, there has been developed a bank note-sorting device for automatically examining bank notes of equal denomination and dividing them onto a group of fit bank notes and a group of unfit bank notes. This device automatically counts the number of bank notes being sorted one by one to detect an excess or shortage of bank notes; finds unfit bank notes, namely, bank notes of different denominations from those being sorted and invalid bank notes; separates fit bank notes into a group of damaged bank notes (those unsuitable for recirculation) and a group of normal bank notes (those qualified for recirculation); and bundles said normal bank notes in batches of 100, finally followed by the impression of a seal by the responsible operator of the above-mentioned machine on a strap fastening a batch of one hundred normal bank notes.

However, the above-mentioned prior art sorting device sorts bank notes in units of 1000. Though capable of discovering the excess or shortage of bank notes relative to units of 1000 or the presence of counterfeit bank notes in said units, yet the conventional sorting device fails to distinguish that batch of 100 bank notes from among units of 1000 in which any abnormality occurred. On the other hand, bank notes are generally fastened by a strap in batches of 100, and then 10 bundles of 100 bank notes are collected to be fastened by a broader strap in units of 1000. While bank notes having as small a number as 1000 are all commonly handled by the same bank, batches of 100 bank notes are often handled by different clerks of said bank. It is therefore considered that demand sometimes arises to identify any of the bank personnel who handled that batch of 100 bank notes in which any abnormality happened to take place. Accordingly, it becomes necessary to handle bank notes in units of 100, instead of units of 1000 practiced in the prior art sorting device, If, however, an attempt is made to meet this demand by handling bank notes in units of 100 using said conventional sorting device originally designed to handle bank notes in units of 1000, then said device as a whole will have to be kept inoperative during the intervals between the confirmation of the number of each preceding batch of 100 and the handling of a counterfeit bank note found in said batch and the same operation of each succeeding batch of 100, thus increasing the overall inoperative period of said device, and prominently reducing its handling capacity. Further, the operator who must frequently feed bank notes in units of 100 to said sorting device is subject to a larger working load. Therefore, application of the prior art sorting device for the above-mentioned object is substantially impracticable.

This invention has been accomplished in view of the above-described situation and is intended to provide a thin sheet-sorting apparatus capable of efficiently and almost continuously sorting thin sheets in units of 100 substantially without loss of time between the sorting operations of the respective units, thereby minimizing the working load of an operator.

According to an aspect of this invention, there is provided a thin sheet-sorting apparatus comprising a feeder for receiving a prescribed number of thin sheets and sorting cards issued for each batch of, for example, 100 sheets included in said number; a device for successively drawing out the respective batches of 100 sheets and the corresponding sorting cards from the feeder; means for dividing the drawn out thin sheets and sorting cards into two groups; and means for collating the data obtained from each group of thin sheets and the information impressed on the corresponding sorting card whereby whether the coincidence between the total number of the sheets of each batch set in said feeder and that of the sheets of the first and second groups was obtained or whether the total number of the sheets of the first and second groups coincides with the prescribed number of sheets of each batch or not can be made possible.

This invention can be more fully understood from the following detailed description when taken in conjunction with the accompanying drawings, in which:

FIGS. 1A and 1B schematically show the arrangement of an entire thin sheet-sorting apparatus according to an embodiment of this invention;

FIG. 2 is a block circuit diagram of an abnormal approach-detecting device included in the detecting device of FIG. 1;

FIG. 3 indicates signal wave forms by way of illustrating the operation of the abnormal approach-detecting device of FIG. 2;

FIG. 4 schematically sets forth the arrangement of the optical system of a soiled thin sheet-detecting device included in the detecting section of FIG. 1;

FIG. 5 is a soiled thin sheet-detecting circuit;

FIG. 6 presents signal wave forms by way of illustating the operation of the circuit of FIG. 5;

FIGS. 7 and 8 schematically show the arrangement of a sorting card-issuing device included in the thin sheet-sorting apparatus of FIG. 1;

FIG. 9 is a block diagram of a control circuit included in the sorting card-issuing device;

FIG. 10 indicates the typical pattern of a strap fastening each batch of, for example, 100 thin sheets;

FIG. 11 shows the typical pattern of a sorting card;

FIG. 12 schematically illustrates the arrangement of a count-collating device included in the thin sheet-sorting device of FIG. 1;

FIGS. 13A–C are block diagrams of a counter circuit;

There will now be described by reference to the appended drawings a thin sheet-sorting device according to an embodiment of this invention. Throughout the following description, the thin sheet is exemplified by a bank note. However, this invention is not obviously limited to this type of thin sheet.

Figure 1A:
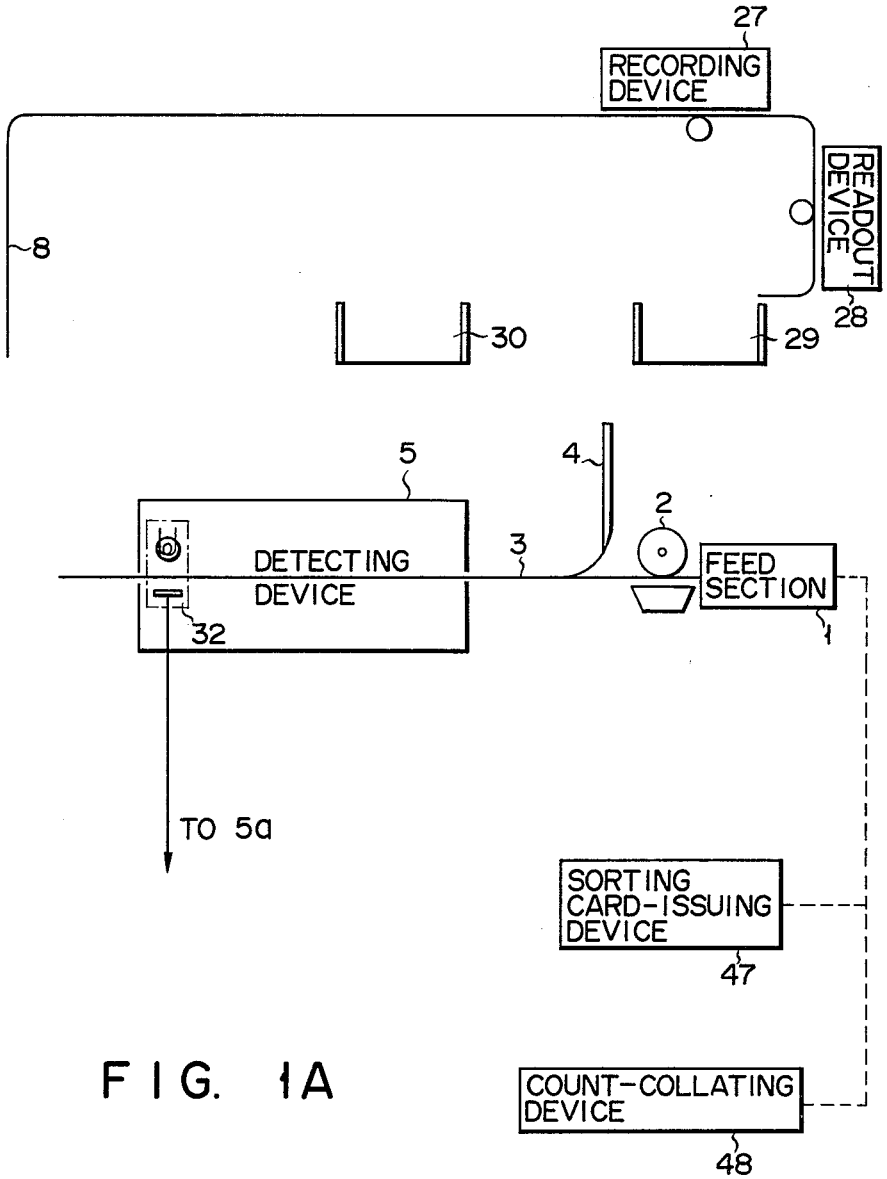
Figure 1B:
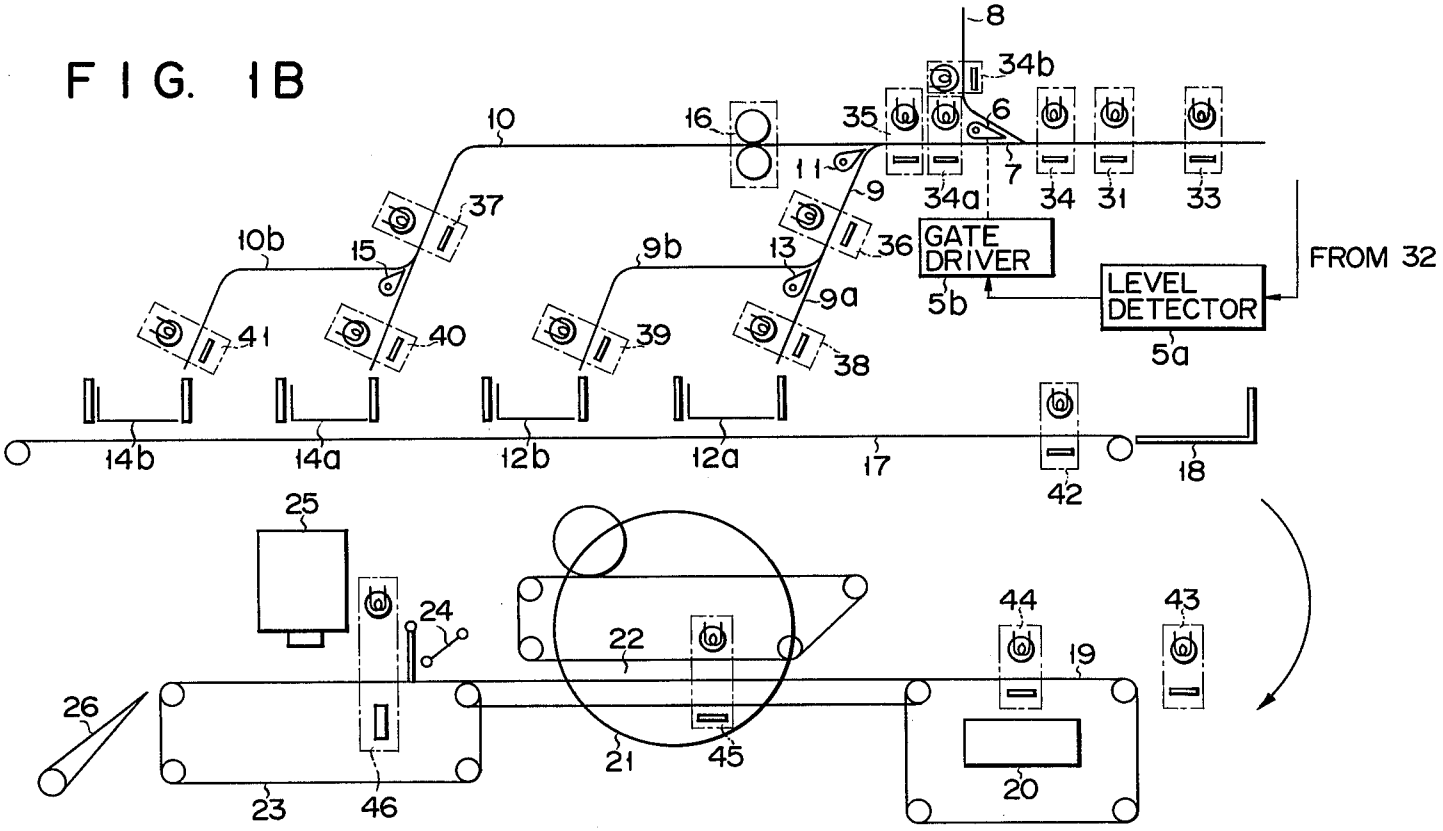

Referring to FIG. 1, referential numeral 1 denotes a feeder, which receives a magazine containing 1000 bank notes being sorted (hereinafter referred to as "notes") together with 10 later described sorting cards inserted for each batch of, for example, 100 notes. When the note-sorting apparatus of this invention is put into operation, the notes and sorting cards are drawn out of the magazine by a pickout device 2 one after another at a prescribed interval. Referential numeral 3 is a conveying device or belt conveyor which clamps a note drawn out by the pickout device 2 between a pair of belts and conducts it to the later described detecting device 5 and a first sorting device 6. Referential numeral 4 is a note-inserting device for, where necessary, manually throwing notes one by one on the belt conveyor 3. The detecting device 5 disposed in the intermediate part of the belt conveyor 3 has a first function of detecting the superposition of two or more notes drawn out by the pickout device 2 which would obstruct the accurate detection and counting of notes. Detection of said superposition may be effected by an output level detector 5*a* which indicates the level of an output from a photoelectric comversion device 32 varying with an amount of light passing through notes. Or said superposition may be detected by mechanically measuring the thickness of notes drawn out by the pickout device 2.

Figure 2:
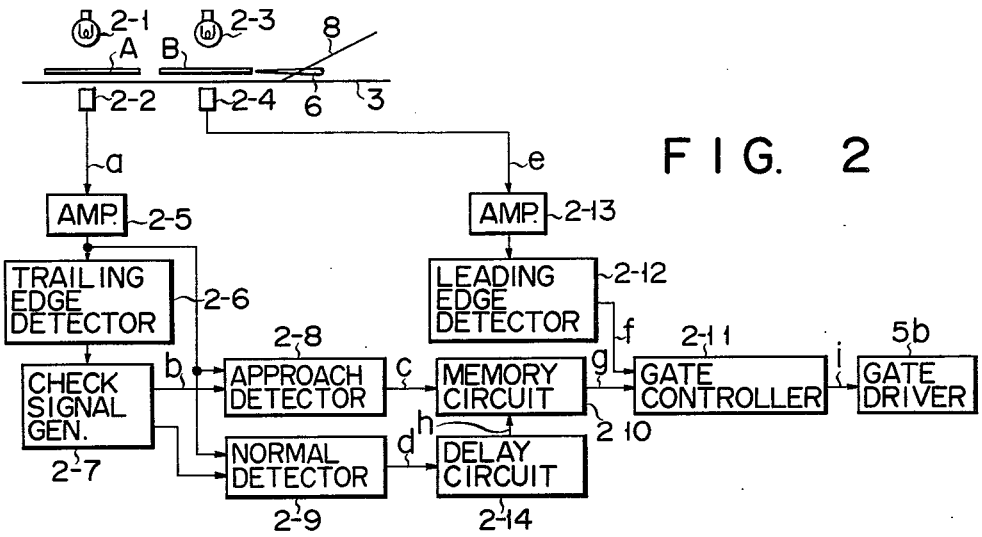
Figure 3:
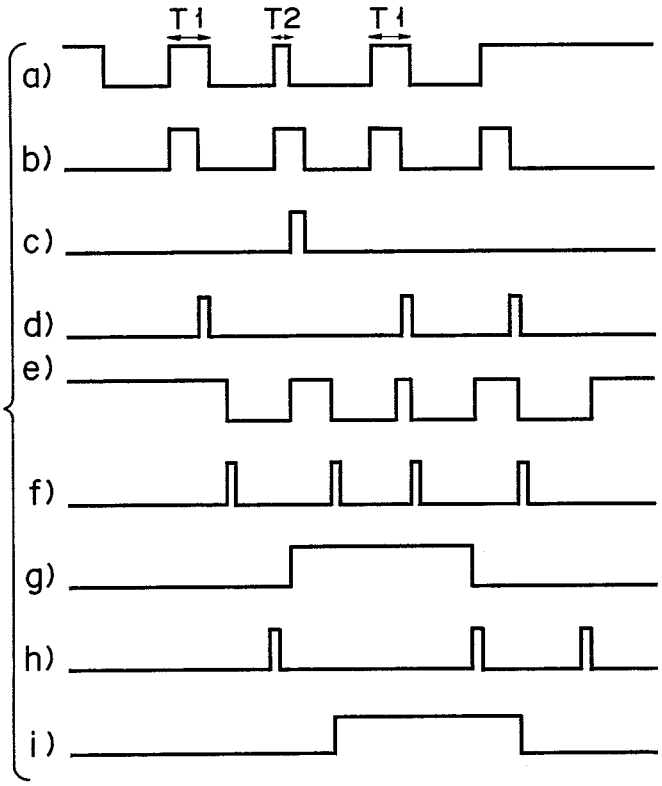

The second function of the detecting device 5 is to find out the case where two or more notes taken out by the pickout device 2 contact each other at the end or abnormally approach each other, similarly resulting in the failure to detect or count normal notes. Detection of the intervals between closely traveling notes is carried out by comparing an interval between any two consecutive notes with a prescribed interval. To this end, as shown in FIG. 2, a lamp 2-1 and photoelectric element 2-2 are provided on both sides of a note A traveling on the conveyor belt 3 and similarly a lamp 2-3 and photoelectric element 2-4 are disposed on both sides of the succeeding note B carried by the conveyor belt 3. The photoelectric element 2-2 gives forth a signal *a* having a wave form shown in FIG. 3*a*. Where the notes A, B are spaced at a normal interval, then the photoelectric element 2—2 continues to produce a high level output for a period of T1. Where both notes A, B unduly approach each other, the high level output lasts for such a short period as T2. The signal *a* is amplified by an amplifier 2-5 and supplied to a rear end detector 2-6, which in turn delivers a signal to a check signal-generating circuit 2-7 in response to the rise of the signal *a* from a low to a high level. Said check signal-generating circuit 2-7 gives forth a pulse signal *b* of fixed time width shown in FIG. 3*b* in response to an input signal received. Said check signal-generating circuit 2-7 should advisably consist of a one-shot circuit. An output signal from the circuit 2-7, together with thesignal *a*, is delivered to a close approach-detector 2-8 and a normal interval detector 2-9. The close approach-detector 2-8 should advisably consist of a flip-flop circuit which is set, for example, by the fall of the signal *a* from a high to a low level and reset by the fall of the signal *b*. Therefore, only where the notes A, B excessively approach each other, the close approach-detector 2–8 produces a signal *c* shown in FIG. 3*c*. On the other hand, the normal interval-detector 2-9 consisting of a flip-flop circuit designed to be set by the fall of the signal *b* from a high to a low level and reset by the fall of the signal *a* from a high to a low level generates a signal *d* shown in FIG. 3*d* only when the notes A, B maintain a normal interval.

Where the notes A, B unduly approach each other, the signal *c* is supplied to the set terminal of the close approach-memory 2-10 which in turn delivers a signal *g* shown in FIG. 3*g* to a gate controller 2-11. This gate controller 2-11 is supplied with a signal *f* shown in FIG. 3*f* from a leading edge detector 2-12, which is supplied with an output signal *e* (shown in FIG. 3*e*) from the photoelectric element 2–4 spaced at a prescribed interval from the photoelectric element 2—2 in the note-feeding direction, and generates an output signal *f* in response to the fall of the signal *e* from a high to a low level (leading edge). Where the notes A, B are drawn duly near to each other, the gate controller 2-11 supplies a signal *i* shown in FIG. 3*i* to a gate driver 5*b*, causing the note B to be sent to another belt conveyor 8 through the gate 6.

Where a normal space is maintained between the notes A, B, then an output signal *d* from the normal interval detector 2-9 is delayed for a prescribed length of time by a delay circuit 2-14, an output signal *h* (shown in FIG. 3*h*) from which is conducted as a reset signal to a memory circuit 2-10. As the result, the signal *g* is brought to a low level and the gate 6 regains its original condition to send the note B back to the belt conveyor 3. As mentioned above, where the notes A, B abnormally approach each other, one of them, for example, the note B is diverted to a separate belt conveyor 8 finally to be returned to the main belt conveyor 3.

The third function of the detecting device 5 is to examine the impression of notes traveling on the belt conveyor 3, thereby separating them into a group of fit notes and a group of unfit notes (for example, notes of different denominations from a given batch of notes now being sorted, invalid notes and those too much soiled for recirculation). Detection of such unfit notes may be effected by any known optical or mechanical process or another process, provided it attained the desired object.

For illustration, there will now be described the operation of a device for separating soiled notes. As shown in FIG. 4, a photoelectric element 4-1 and a convex lens 4-2 are provided to face each other on both sides of the note A traveling on the belt conveyor 3 in the direction of the indicated arrow. That surface of the note A which faces the convex lens 4-2 receives a light emitted from lamps 4-3, 4-4 through the corresponding lenses at an angle of substantially 45° relative to said note surface. Reflections from the illuminated surface of the note A pass through the convex lens 4-2 to a photoelectric element 4-5. On the other hand, beams of light penetrating the note A are received by the photoelectric element 4-1. The lens 4-2, lamps 4-3, 4-4 and photoelectric element 4-5 are all enclosed in a box 4-6. Further provided on both sides of the note A are a lamp 4-7 and a photoelectric element 4-8 so as to give forth a timing signal for controlling the operation of this soiled note-detecting device.

It is generally difficult to detect soils from the pattern impressed on the surface of a bank note, because the soiled portions and unsoiled portions of said pattern do not indicate any noticeably different optical property. Therefore, detection should be made of soils appearing on those portions of the note surface where no or substantially no impression is printed. Further, the printed pattern of a note is generally unsymmetrical in the direction in which the note travels, for example, on a belt conveyor. For detection of soils regardless of such unsymmetrical pattern, therefore, it is necessary to select at least two symmetrical spots in the forward and rear sections of a traveling note and detect soils, if any, appearing on said spots.

An output signal from the photoelectric element 4-1 is amplified by an amplifier 5-1 of FIG. 5, which in turn supplies an amplified output signal *j* to one input terminal of each of four comparators 5-2, 5-3, 5-4, 5-5. Referring to FIG. 6*a*, the signal *j* indicates, for example, that a soild appears on the first detected spot I of the note B traveling backward on the belt conveyor 3, causing the signal *j* to be brought to a lower level than the standard; the second detected spot II of the note B is free from a soil; and neither of the detected spots of the note A conducted on the belt conveyor in the forward direction has any soil. The other input terminals of the comparators 5-2, 5-3 are respectively impressed with an upper limit voltage VIu and lower limit voltage VIl of the standard output level specified for the first detected spot I. The other input terminals of the comparators 5-4, 5-5 are respectively supplied with an upper limit voltage VIIu and a lower limit voltage VIIl of the standard output level specified for the second detected spot II.

Output signals from the comparators 5-2, 5-3 are conducted through the corresponding inverters to an OR gate 5-6, and output signals from the comparators 5-4, 5-5 are supplied through the corresponding inverters to an OR gate 5-7. An output signal *k* from the OR gate 5-6 is delivered to one input terminal of each of NAND gates 5-8, 5-9 and an output signal *l* from the OR gate 5-7 is supplied to one input terminal of each of the NAND gates 5-10, 5-11. The other input terminals of the NAND gates 5-8, 5-10 are respectively impressed with timing signals T2, T3, shown in FIGS. 6*c* and 6*d*, and the other input terminals of the NAND gates 5-9, 5-11 are respectively supplied with timing signals T2, T3. The output signals *k*, *l* from the OR gates 5-6, 5-7 respectively indicate the wave forms shown in FIGS. 6*f*, 6*g*. Output signals from the NAND gates 5-8 to 5-11 are delivered to the set input terminals of flip-flop circuits 5-12, 5-13, 5-14, 5-15. The reset input terminals of these flip-flop circuits are impressed with a timing signal TI shown in FIG. 6*b*. Output signals from the flip-flop circuits 5-12, 5-13 are supplied to the corresponding input terminals of a NAND gate 5-16, and output signals from the flip-flop circuits 5-14, 5-15 are delivered to the corresponding input terminals of a NAND gate 5-17. Output signals from the NAND gates 5-16, 5-17 are sent to an OR gate 5-18 through the corresponding inverter. An output signal *m* from the NAND gate 5-10 has such a wave form as drawn in FIG. 6*h*. An output signal from the OR gate 5-18, together with a timing signal T4 shown in FIG. 6*e*, is conducted to the input terminal of a NAND gate 5-19. The forward circuit of FIG. 5 is actuated when a note is carried on the belt conveyor 3 such that the first detected spot I of the note coincides with the timing signal T2 and the second detected spot II thereof coincides with the timing signal T3, whereas the "reverse" circuit is operated when the note travels in the opposite direction. In the reverse operation, there is generated a signal O shown in FIG. 6*i* which denotes detecton of a soil in the first detected spot I of the note B coinciding with a timing signal T4. Said soil detection signal O is used to drive the gate 11 of FIG. 1.

Referring to the detecting section 5 of FIG. 5, it is possible to incorporate an optical character-reading device and separate notes bearing earlier years of issue. At any rate, one or plural detecting devices are used to meet the intended object. In the latter case, any of the combined detecting devices judges each note as to its fitness, slight dirtiness still available for recirculation, or unfitness including the cases where the note is legally invalid, where it is of different denomination from a given batch of notes now being sorted and where it is superposed on another note. As the results of these judgments, a final decision is given on a given note in the undermentioned grading order.

| Order | Final Decision | Grading order Reason |
|---|---|---|
| 1st | Invalid | Any of the members of the detecting device decides the note to be invalid. |
| 2nd | Soiled | Though none of the members of the detecting device decide the note to be invalid, at least one member thereof judges said note to be undesirably soiled. |
| 3rd | Normal | None of the members of the detecting device decide the note to be invalid or soiled, but all the members thereof judge the note to be normal. |

Referring to FIG. 1, referential numeral 6 denotes a sorting gate which delivers a note traveling on the belt conveyor 3 and passing through the detecting device 5 either to a first conveying passageway 7 or a second conveying passageway 8 according to the decision given by said detecting device 5. A note judged invalid by the detecting device 5 is diverted to the second conveying passageway 8. A note decided to be soiled or normal is transported on the first conveying passageway 7. When picked out, a sorting card is also guided, as later described, to the second conveying passageway 8. The first conveying passageway 7 is branched into a passageway 9 for delivering a normal note to the later described collector and a passageway 10 for conducting a soiled note to the later described collector. Referential numeral 11 is a second sorting device, which is disposed at the junction and has its operation controlled by an output signal from the later described note-locating circuit. The normal note-conveying passageway 9 is again branched into a passageway 9*a* for carrying a normal note to a first normal note collector 12*a* and a passageway 9*b* for conveying a second normal note collector 12*b*. Provided at the junction is a third sorting device 13, whose operation is controlled by an output signal from the later described counter. The soiled note-conveying passageway 10 is further branched into a passageway 10*a* for conducting a soiled note to a first soiled note collector 14*a* and a passageway 10*b* for sending a soiled note to a second soiled note collector 14*b*. A fourth sorting device 15 located at the junction has its operation controlled by an output signal from the later described counter. The abovementioned collectors 12*a*, 12*b*, 14*a*, 14*b* are each provided with a vertically movable bottom plate for orderly accumulation of incoming notes one atop another. The operation of each of these collectors is controlled by an output signal from the corresponding counter. Referential numeral 16 is a cancellation stamp device, which impresses a cancellation mark on those notes conveyed by the passageway 10 which are too much soiled for recirculation. However, it is not always necessary to provide this cancellation stamp device 16.

Referential numeral 17 is a device for conveying a batch of, for example, 100 notes. This note batch-conveying device 17 takes out said batch of 100 notes collected in each of the collectors 12*a*, 12*b*, 14*a*, 14*b* and conducts it to a course-changing device 18, which changes the course of a traveling note batch by 90° and sends it to a note batch-conveying passageway 19, which in turn conducts the note batch delivered from the course-changing device 18 to a note batch-rearranging device 20 for setting the superposed condition of the note batch in good order. Referential numeral 21 is a strapping device for fastening the rearranged note batch so as to prevent it from being put out of shape. Referential numerals 22, 23 are conveying passageways, and referential numeral 24 is a strap-checking device for examining whether the note batch is firmly fastened by a strap. Referential numeral 25 is a printing device for impressing the surface of a strap wound about a note batch with required items such as a date of sorting, operator's mark and the number of a sorting apparatus used, and a mark distinguishing between a batch all consisting of normal notes and that of soiled notes. Referential numeral 26 is a note batch-sorting device for selecting a proper note batch collector (not shown) for receiving a batch of normal or soiled notes. The above-mentioned cause-changing device 18, rearranging device 20, strapping device 21, printing device 25 and note-batch sorting device 26 are operated under control by an output signal from the later described note-batch locating circuit.

Referential numeral 27 is a recording device which, under a normal condition, magnetically impresses a sorting card brought through the second conveying passageway 8 with a value arrived at by subtracting the total number of normal and soiled notes preceding the sorting card from the number, for example, 100 of a batch constituted by the normal and soiled notes. Assuming that any of the already sorted 100-note batches neither exceeds nor falls short of 100, the remainder of 100 arrived at by subtracting the total number of normal and soiled notes from 100 represents the number of unfit notes which are expected to be received in the unfit note collector 29. Where any abnormality arises, the aforesaid recording device 27 magnetically records the sequential number which the occurrence of said abnormality bears among, for example, 10 batches of 100 notes on a sorting card associated with an abnormal batch. Referential numeral 28 is a readout device for examining whether the recording device 27 correctly recorded data. These recording device 27 and readout device 28 are operated under control by an output signal from the later described corresponding counter. The unfit note collector 29 is detachably provided and accumulates unfit notes and sorting cards brought through the second conveying passageway 8 one atop another in good order. Referential numeral 30 is a detachably disposed return note box for receiving a note batch in which any abnormality took place and which was manually removed from any of the note collectors 12*a*, 12*b*, 14*a*, 14*b*.

Referential numeral 31 is a sorting card detector disposed between the detecting device 5 and the first sorting device 6 to detect the timing in which a sorting card issued for each batch of 100 notes passes the prescribed detection point. The timing thus detected constitutes the basis on which the later described collation is made of the number of 100-note batches counted. To this end, ordinary bank notes should not be mistaken for sorting cards. To avoid such confusion, therefore, sorting cards are made larger than ordinary bank notes so as to attain the reliable detection of the above-mentioned timing. The sorting card detector 31 is of, for example, an optical type comprising a light source and a light-receiving element so as to detect a sorting card from a difference between the size of the sorting card and that of an ordinary bank note. Referential numerals 32 to 41 denote note detectors each consisting of, for example, a light source and light-receiving element and occupying a prescribed position. Referential numerals 42 to 46 are note batch detectors each formed of, for example, a light source and light-receiving element and located at a prescribed point.

Referential numeral 47 is a sorting card-issuing device and 48 is a count-collating device. There will now be described the operation of these devices. The sorting card-issuing device 47 first records required items on a strap fastening a batch of, for example 100 notes being sorted, and prepares a card bearing a magnetic tape which is stored with data codified from the information impressed on the strap. The sorting card-issuing device 47 comprises, as shown in FIG. 7, a strap inlet 51; a conveying device 52 for conducting the strap inserted; a strap detector 53 for detecting the passage of the strap; a printer 54 for digitally recording required items on the incoming strap; tape reels 55*a*, 55*b* for supplying a pair of tapes clamping the strap impressed with digital data; a take up reel 56 for taking up the paired tapes clamping the strap for storage; a magnetic tape reel 57 shown in FIG. 8 for supplying a magnetic tape; a sorting card stock reel 58 for supplying a ribbon-shaped sorting card stock being later fitted the magnetic tape; a cutter device 59 for bonding the magnetic tape to the incoming ribbon-shaped sorting card stock and cutting up the bonded mass in pieces bearing a prescribed length to provide separate sorting cards; a magnetic recording device 60 for impressing a magnetic tape carried by each cut sorting card with data codified from the information recorded on the strap; a sorting card detector 61; a sorting card conveying passageway 62; and a sorting card discharging passageway 63. The above-mentioned strap detector 53 and sorting card detector 61 are each of an optical type consisting of, for example, a light source and light receiving element.

Figure 9:
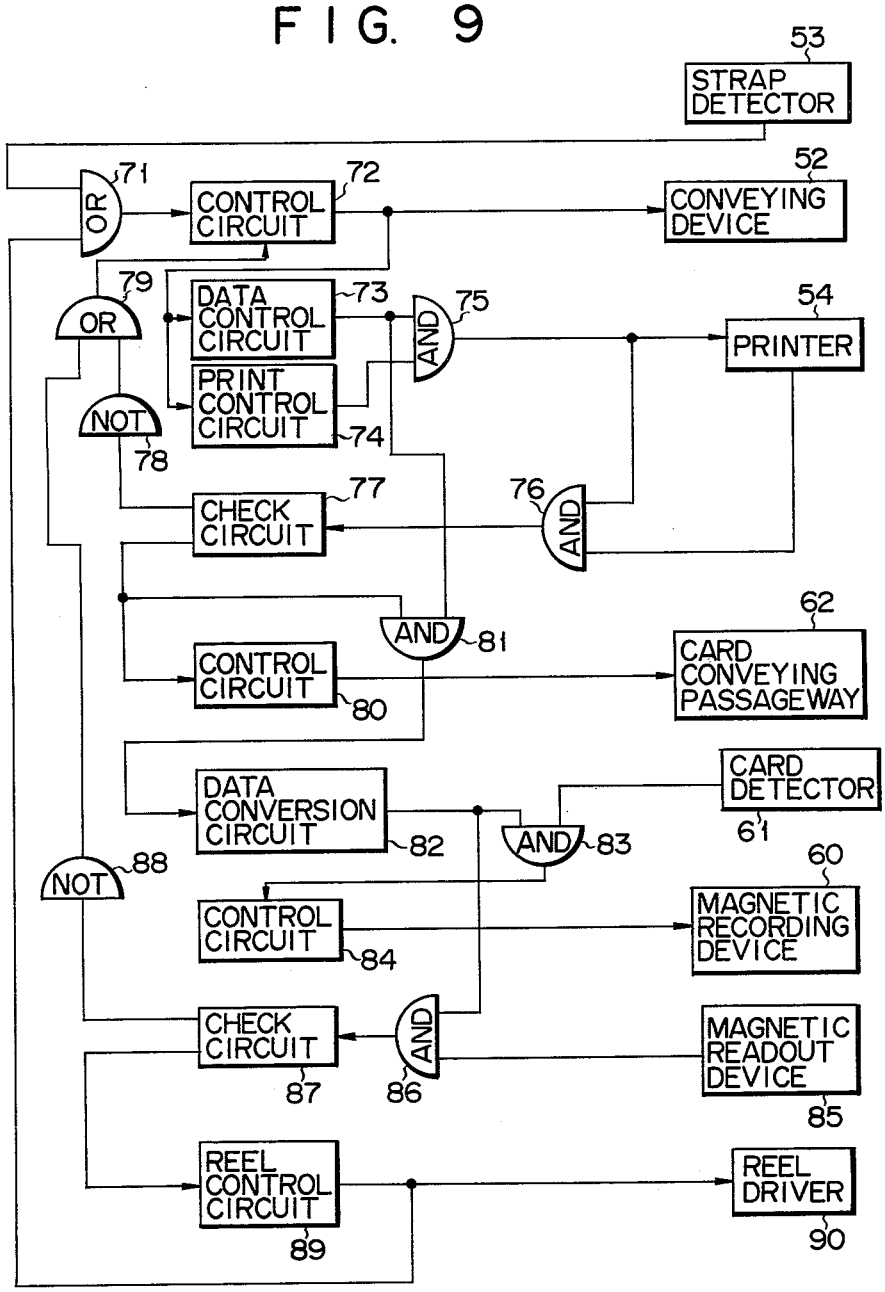

There will now be described the operation of the sorting card-issuing device by reference to the block circuit diagram of FIG. 9. First, an operator takes off a strap fastening a batch of, for example, 100 notes being sorted, and puts the strap in the inlet 51. The conveying device 52 which is now in operation carries the strap forward. A signal denoting the detection of the strap by the detector 53 is supplied to a conveying device control circuit 72 (FIG. 9) through an OR circuit 71, thereby stopping the operation of the conveying device 52. Further upon detection of the strap, the control circuit 72 gives forth a signal, which actuates a data control circuit 73 and print control circuit 74. Data read out from a data memory (not shown) and an output signal from the print control circuit 74 are supplied to an AND circuit 75 which gives forth a logical product. As the result, the printer 54 records required data on the strap. An output signal from the AND circuit 75 (data read out from the memory) and an output signal from the printer 54 are conducted to a check circuit 77 through an AND circuit 76 for comparison between both output signals, thereby examining whether the printer 54 recorded correct data. Where the result of said examination proves the absence of any abnormality, then a signal denoting this fact is supplied to the conveying device control circuit 72 through an NOT circuit 78 and OR circuit 79. Accordingly, the conveying device 52 is again operated to deliver forward the strap now bearing recorded data to the take up reel 56. Where absence of any abnormality is provided by the above-mentioned examination, a circuit 80 for controlling the sorting card stock-conveying passageway 62 is actuated to drive said conveying passageway 62. A magnetic tape is bonded to the ribbon-shaped sorting card stock. The bonded mass is cut up in pieces bearing a prescribed size. At this time, data read out by the data control circuit 73 is conducted to a data conversion circuit 82 for codification, and then to an AND circuit 83. When a cut sorting card is detected by the sorting card detector 61, then a signal denoting said detection, an output signal from the control circuit 80 of the sorting card stock-conveying passageway 62 and an output signal from the data conversion circuit 82 are supplied to the AND circuit 83 which generates a logical product signal. As the result, a circuit 84 for controlling the magnetic recording device 60 is operated to cause said device 60 magnetically to record data on a magnetic tape carried by a sorting card. Thereafter, a magnetic readout device 85 reads out data thus recorded on the magnetic tape to examine whether said data is correct. A signal denoting the data thus read out and an output signal (data being written) from the data conversion circuit 82 are delivered to a check circuit 87 through an AND circuit 86. While comparison is made between the data read out and the data being written by the check circuit 87, the sorting card is taken out of the sorting card-issuing device 47 through the discharge passageway 63. Where the check circuit 87 proves absence of any abnormality as the result of the above-mentioned comparison, a signal denoting this fact is conducted to the conveying device control circuit 72 through an NOT circuit 88 and OR circuit 79, causing the conveying device 52 to be again driven so as to undertake the conveyance of the succeeding bank note strap. Further, where the above-mentioned check circuit 87 proves absence of any abnormality, a reel control circuit 89 and in consequence a reel driving device 90 are operated, causing the tape reels *55a, 55b* and takeup reel 56 to be driven, thereby keeping a plurality of straps (for example, 10 straps fastening 10 batches of 100 notes) on the take up reel 56.

On the other hand, where any abnormality is detected as the result of comparison by the aforesaid check circuits 77, 87, then the conveying device 52 is driven backward to return the strap fastening a note batch in which the abnormality was discovered to the strap inlet 51. At this time, an indication is made on a display board (omitted from the drawing), showing that it has become necessary to insert and strap again into the inlet 51.

Figure 10:
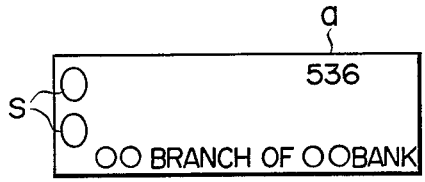
Figure 11:
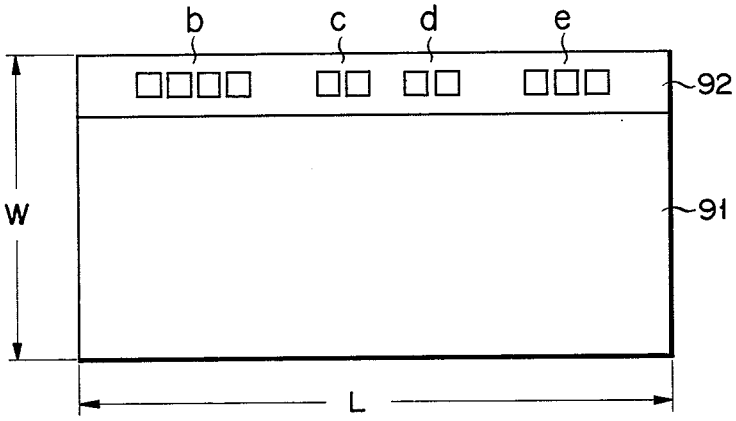

A bank note strap handled by the sorting card-issuing device 47 has a typical pattern as set forth in FIG. 10. The character *a* denotes data recorded on a sorting card and the characters *s*'s represent persons responsible for a given batch of notes. A sorting card 91 prepared by said issuing device 47 has a pattern as illustrated in FIG. 11. A magnetic tape 92 is pasted along one of the longitudinal sides of the sorting card 91. The tape 92 is magnetically impressed with the codified forms of the respective items of information to be given on the sorting card. The character *b* of FIG. 11 is an item corresponding to that recorded in a strap; the character *c* indicates the presence or absence of an abnormality; the character *d* sets forth the sequential number of a sorting card fastening a note batch in which an abnormality occurred; and the character *e* shows the number of notes which are expected to be received in the portable note box 30 or unfit note collector 29. The sorting card 91 is designed to be about 20 mm wider than, and as long as, a note.

Figure 12:
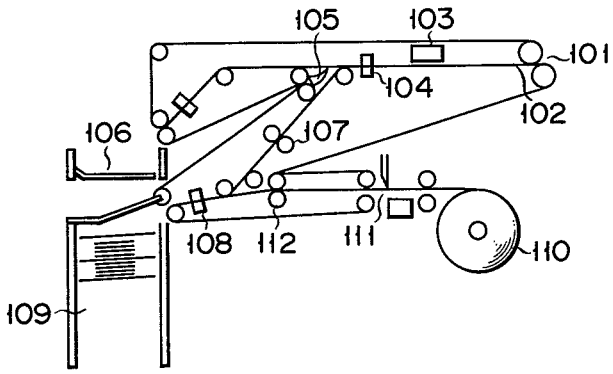

Referring to FIG. 12, the count-collating device 48 carries out the collation of counts for each batch of, for example, estimated 100 notes already sorted, thereby indicating the excess of shortage of notes constituting said batch. The count-collating device 48 comprises an inlet 101 through which sorting cards and notes are inserted into said count-collating device 48; a conveying device 102 for carrying forward the inserted sorting cards and notes; a readout device 103 for reading out data recorded on each sorting card; a counter 104 for detecting and counting incoming notes; a sorting device 105 for separating each batch of notes from the corresponding sorting card; a sorting card stacker 106 for stacking collected sorting cards; a cancellation mark printer 107 for impressing a cancellation mark on an unfit note; another counter 108 of the same arrangement as the first mentioned counter 104; a note-stacking device 109 for stacking collected notes; a sorting paper roll 110 holding sorting paper used to group notes into batches of 100; a cutter device 111 for cutting up the sorting paper in pieces having a prescribed length; and a conveying passageway 112 through which the cut pieces of sorting paper are transported.

There will not be described the operation of the count-collating device 48. When a start switch (not shown) is thrown in, the conveying device 102 is driven. Under this condition, a sorting card is first put in the inlet 101. Since the sorting card inserted is impressed with the number of notes being later inserted, the recorded data of said card is read out by the readout device 103 during the transit of said card to be stored in a separate counter (not shown). Thereafter, the sorting card is sent to the sorting card stacker 106. When the sorting card is received in said stacker 106, the notes constituting a batch represented by said sorting card are put one after another in the inlet 101 to be carried forward. The notes thus inserted are counted by the counters 104, 108 and finally stacked in the note-stacking device 109. When the notes collected in said stacking device 109 amounts to 100, then the sorting paper roll 110 is actuated. A piece having a prescribed length is cut out of the sorting paper held by said roll 110. The cut piece is placed on a batch of 100 notes, enabling said batch to be externally confirmed. Where a stop switch (not shown) is pushed when all the notes being sorted have been inserted, the count-collating device 48 is brought to rest. At this time, comparison is made between the counts made by the counters 104, 108 and the number of notes read out of the sorting card and stored in a separate counter, thereby effecting the collation of the number of each batch of 100 notes. Where said collation proves coincidence between the counts made by the counters 104, 108 and the number stored in said separate counter, indication is made to that effect. Thereafter, the conveying device 102 is again put into operation ready to receive a succeeding sorting card and a batch of estimated 100 notes represented thereby. Conversely, where no coincidence appears between the counts made by the counters 104, 108 and the number of notes read out of the sorting card and stored in a separate counter, then indication is made to that effect, looking the count-collating device 48 to an inoperative state.

Figure 13A:
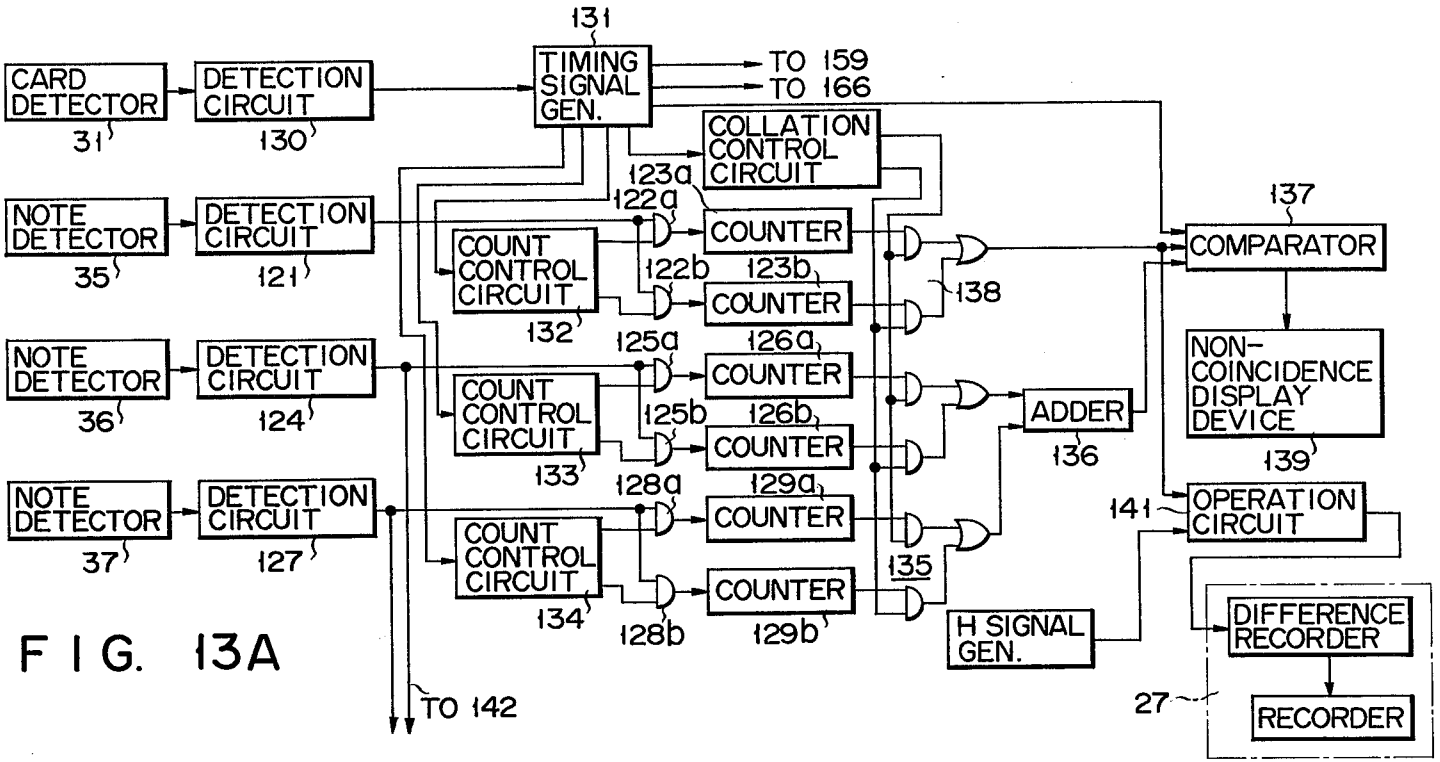
Figure 13B:
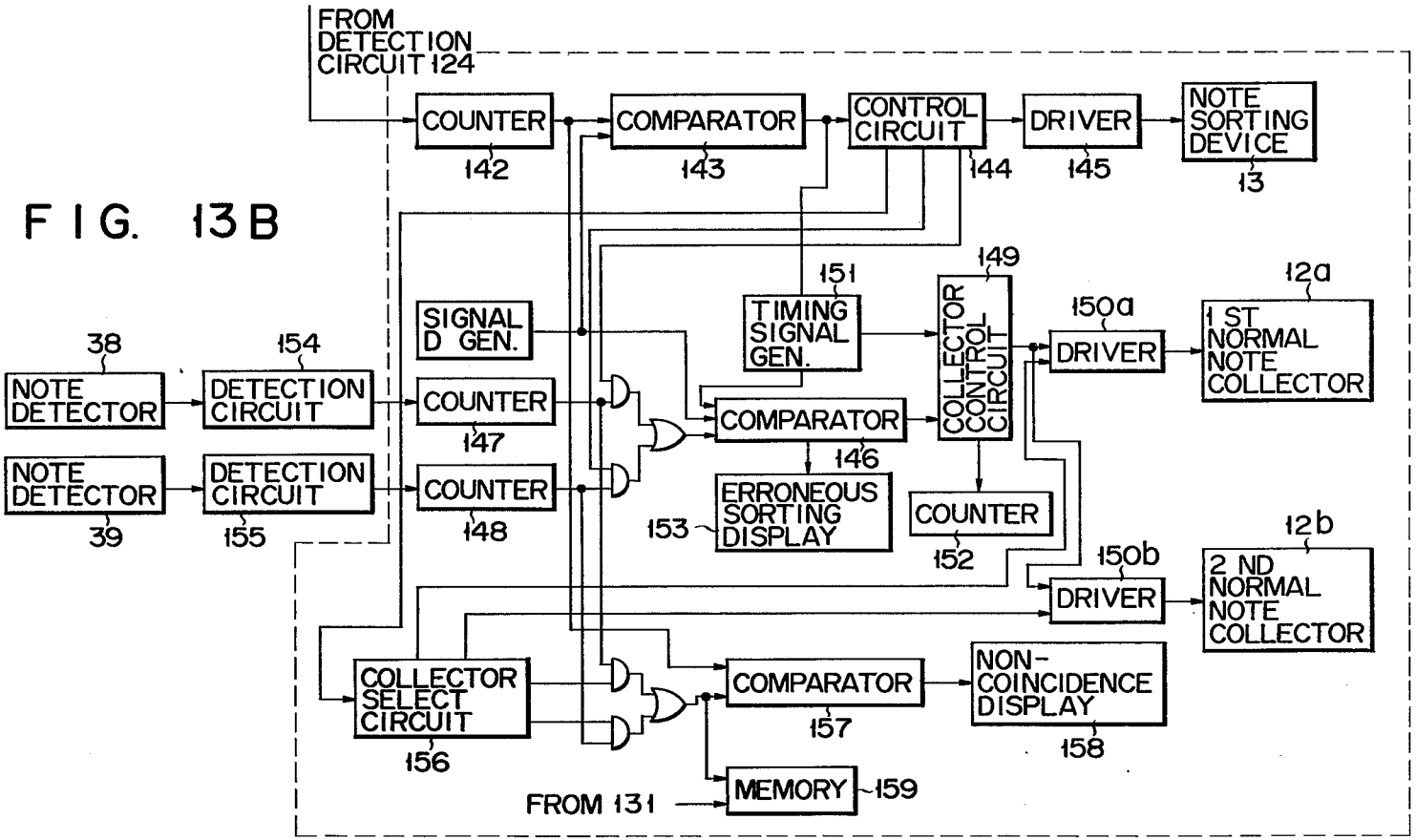
Figure 13C:
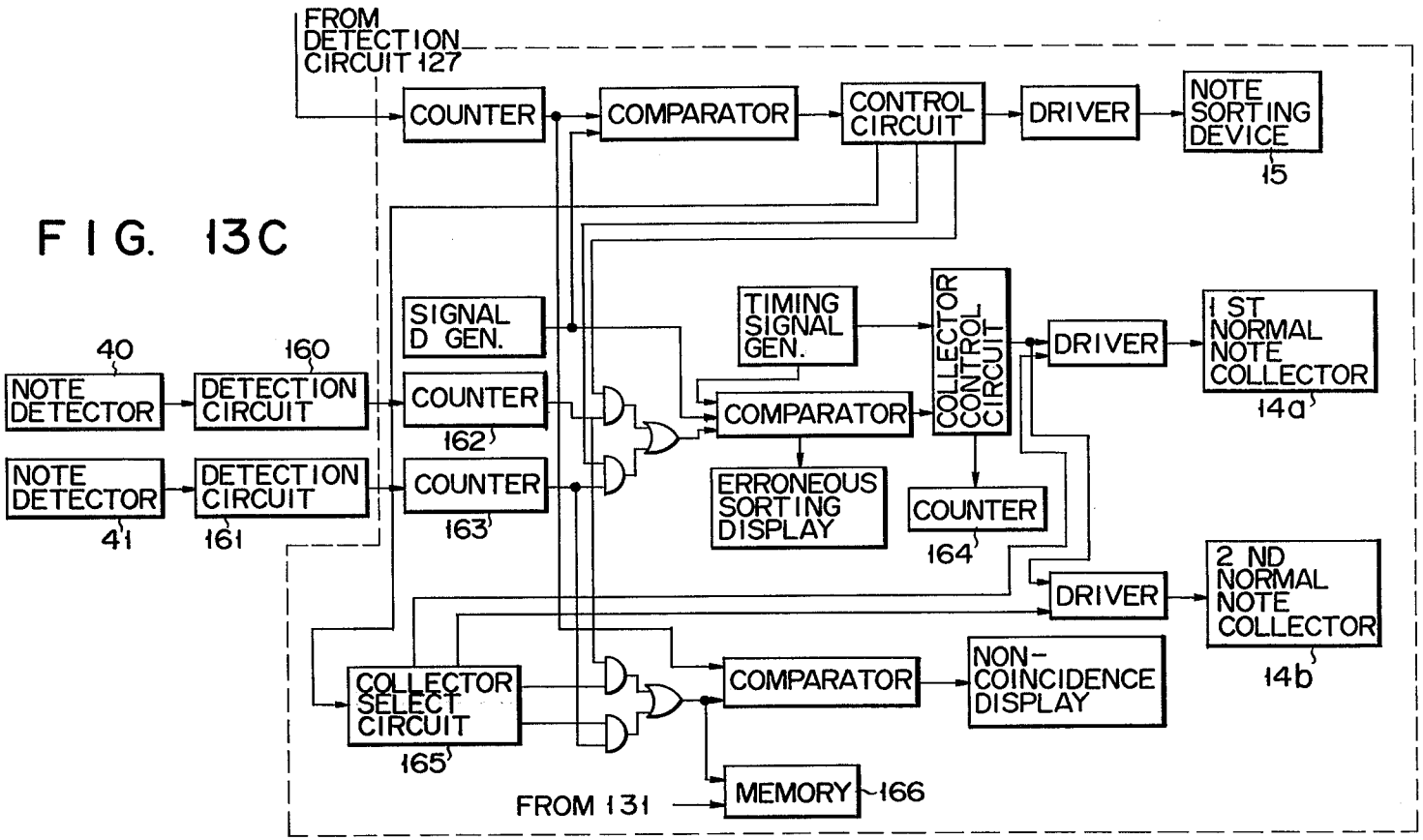

There will not be described a counting system consisting of a plurality of counters used with the thin sheet sorting apparatus of this invention. The counting system counts the numbers of those of the notes supplied to the subject sorting apparatus which are collected in the normal note collectors 12*a*, 12*b* and soiled note collectors 14*a*, 14*b*, and compares the total number of normal and soiled notes with a prescribed value denoting a batch of notes, thereby figuring out the number of unfit notes which are expected to be received in the unfit note collector 29. This counting system is arranged as shown in FIG. 13. Assuming that the notes being supplied to the sorting apparatus of this invention has a number corresponding to a preset value H, then a sum of the total number of notes collected in the normal note collectors 12*a*, 12*b* and soiled notes collectors 14*a*, 14*b* and the number of notes received in the unfit note collector 29 should amount to a value corresponding to said preset value H. The output terminal of a detection circuit 121 connected to a note detector 35 is connected to total number counters 123*a*, 123*b* through AND circuits 122*a*, 122*b*. The output terminal of a detection circuit 124 connected to a note detector 36 is connected to total number counters 126*a*, 126*b* through AND circuits 125*a*, 125*b*. The output terminal of a detection circuit 127 connected to a note detector 37 is connected to total number counters 129*a*, 129*b* through AND circuits 128*a*, 128*b*. The output terminal of a detection circuit 130 connected to a sorting card detector 31 is connected to a timing signal generator 131, which supplies timing signals to count control circuits 132, 133, 134. These count control circuits 132, 133, 134 control the operations of the AND circuits 122*a* – 122*b*, 125*a* – 125*b* and 128*a* – 128*b* such that a group of the counters 123*a*, 126*a*, 129*a* and another group of the counters 123*b*, 126*b*, 129*b* are operated alternately. A certain length of time after a sorting card passes through the first sorting device 6 (FIG. 1), the counts made by the counter 126*a* (126*b*) and the counter 129*a* (129*b*) are supplied to an adder 136 through a gate circuit 135 to be added together. The sum of said addition is conducted to a comparator 137 which is also supplied with the count made by the counter 123*a* (123*b*) through a gate circuit 138, thereby collating an output signal from the adder 136 with the count made by the counter 123*a* (123*b*). Where said collation detects any noncoincidence, or the presence of any abnormality, then a noncoincidence display device 139 indicates noncoincidence. The gate circuits 135, 138 are operated under control by a collation control circuit 140 connected to a timing signal generator 131. An arithmetic operation circuit 141 subtracts the count made by the counter 123*a* (123*b*) from a value H representing the estimated number of inserted notes and delivers the resultant balance to the recording device 27 (FIG. 1), which in turn impresses said balance on the sorting card. If, in this case, the above-mentioned collation proves coincidence, then said balance obtained by the arithmetic operation circuit 141 should denote the number of unfit notes. When comparison is made between the actually counted number of unfit notes collected in the unfit note collector 29 and the above-mentioned balance obtained by the arithmetic operation circuit 141 which is supplied to the recording device 27 to the impressed on the sorting card and coincidence is established by said comparison, then the number of notes supplied to the sorting apparatus can be determined, showing whether any difference occurs between the counted number of notes and the initially estimated number thereof. The above-mentioned collation is carried out each time a sorting card passes the sorting card detector 31. Since, at this time, two groups of counters 123*a*, 126*a*, 129*a* and 123*b*, 126*b*, 129*b* are alternately used, collation of the number of notes can be automatically effected without stopping their travel.

There will now be described the method of ascertaining the number of notes stacked in the respective collectors. When a count made by a normal note counter 142 upon receipt of an output signal from the note detector 36 reaches the estimated number of 100, then a comparator 143 produces a signal, which is supplied to the control circuit 144 and in consequence to the drive circuit 145 of the note-sorting device 13 for its operation. The notes supplied to the subject sorting apparatus are collected in one of the two collectors provided for each type of notes. Now, let is be assumed that 100 notes are collected in the first normal note collector 12*a* and the operation of the note-sorting device 13 has been switched over to collect the succeeding batch of notes in the second normal note collector 12*b*. Then a comparator 146 compares an estimated number D of notes (100 in this embodiment) and the count made by the counter 148 selected by the control circuit 144 from among the two counters 147, 148. When comparison proves coincidence between both values, then the first normal note collector 12*a* is operated by an output signal from a collector control circuit 149 through a collector drive circuit 150 to discharge the batch of 100 notes collected in said collector 12*a*. The comparator 146 and collector control circuit 149 are operated in accordance with a timing signal given forth by a timing signal generator 151 which is actuated by an output signal from the comparator 143. When the operation of the first normal note collector 12*a* is brought to an end upon removal of 100 notes therefrom, then a normal note batch counter 152 is advanced +100. Where the above-mentioned comparator 146 discovers noncoincidence between the estimated number D of notes and the count made by the counter 148, then an erroneous sorting display device 153 is actuated to stop the subject sorting apparatus. The counters 147, 148 count output signals from note detecting circuits 154, 155 connected to the note detectors 38, 39 respectively. An output signal from the control circuit 144 is delivered to a collector-selecting circuit 156, which in turn selects a collector driving circuit 150*a* or 150*b* according to said output signal. This collector-selecting circuit 156 selectively reads out either the count made by the counter 147 or the count made by the counter 148. The selected count is supplied to a comparator 157, where comparison is made between said selected count and the count made by the counter 142. Where said comparison proves noncoincidence between both values, then a noncoincidence display device 158 is actuated. The count made by the counter 147 or 148 selected by the collector selecting circuit 156 is stored in a memory device 159.

The note detectors 40, 41 are connected to the corresponding note-detecting circuits 160, 161, output signals from which are counted by counters 162, 163 respectively. As in the case of the normal notes, the note-sorting device 15 delivers soiled notes either to the first soiled note collector 14*a* or to the second soiled note collector 14*b*. When soiled notes are taken out of the collector 14*a* or 14*b*, then a note batch counter 164 is advanced +100. The count made by the counter 162 or 163 selected by a collector-selecting circuit is stored in a memory device 166.

Where an abnormality takes place such as the jamming of notes, the erroneous location of notes, or the omitted collation of counts, then all notes brought into the normal and soiled note collectors are taken out. These normal and soiled notes and the unfit notes received in the unfit note collector 29 are put together without again feeding the normal and soiled notes to the sorting apparatus. The total number of the normal, soiled and unfit notes is manually counted, thereby ascertaining the estimated number (for example, 100) of notes initially supplied to the sorting apparatus. In case of normalcy, the number Q of unfit notes received in the unfit note collector 29 may be expressed as follows:

$$Q = H - G_1 (G_2)$$

where:

H = estimated number of notes supplied $G_1(G_2)$ = count made by the total number counter 123*a* (123*b*)

In case of abnormality, the total number of normal and soiled notes taken out of the normal note collectors 12*a*, 12*b* and the soiled note collectors 14*a*, 14*b* and unfit notes received in the unfit note collector 29 are summed up as expressed by the following equation:

1. where an abnormality occurs while notes constituting a given batch are supplied:

$$Q = H - G + RA + RU - PA - PU$$

where:

$G = G_1 + G_2$

RA = data stored in the memory device 166

RU = data stored in the memory device 159

PA = count made by the counter 164

PU = count made by the counter 152

2. where an abnormality arises while notes constituting a batch bearing the order of $n$ and those of the order of $n + 1$ are supplied continuously:

$$Q_n = H = G_n + RA + RU - PA - PU + G(n+1)TR$$

$$Q_{n+1} = H - G(n+1)TR - G(n+1)$$

where:

$G_n$ = count made by the total number counter 123*a* (123*b*) with respect to the notes constituting a batch bearing the order of $n$ $G(n+1)TR$ = number of those of the notes constituting a batch bearing the order of $n + 1$ which were supplied during a period extending from the occurrence of an abnormality and the elimination thereof $G(n+1)$ = number of those of the notes constituting a batch bearing the order of $n + 1$ which were supplied after elimination of the abnormality.

Figure 14:
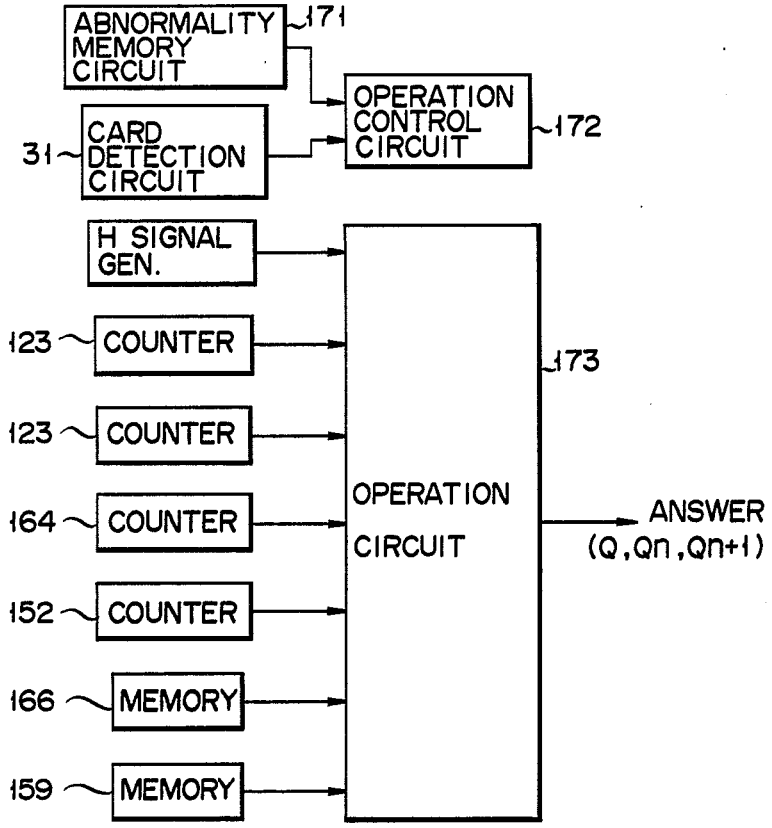
FIG. 14 is a block diagram of an arithmetic operation circuit and other devices associated therewith.

The above-mentioned arithmetic operations can be easily carried out by a circuit shown in FIG. 14. Referential numeral 171 is a memory circuit for memorizing a signal denoting an abnormality, 172 is an arithmetic operation control circuit and 173 is an arithmetic operation circuit. The arithmetic operation system of FIG. 14 is supplied with the estimated number H of notes initially supplied to the sorting apparatus and data stored in the counters 123*a*, 123*b*, 164, 162, 152 and the memory devices 166, 159, and carries out the above-mentioned arithmetic operations to give answers Q, $Q_n$, $Q_{n+1}$.

Figure 15:
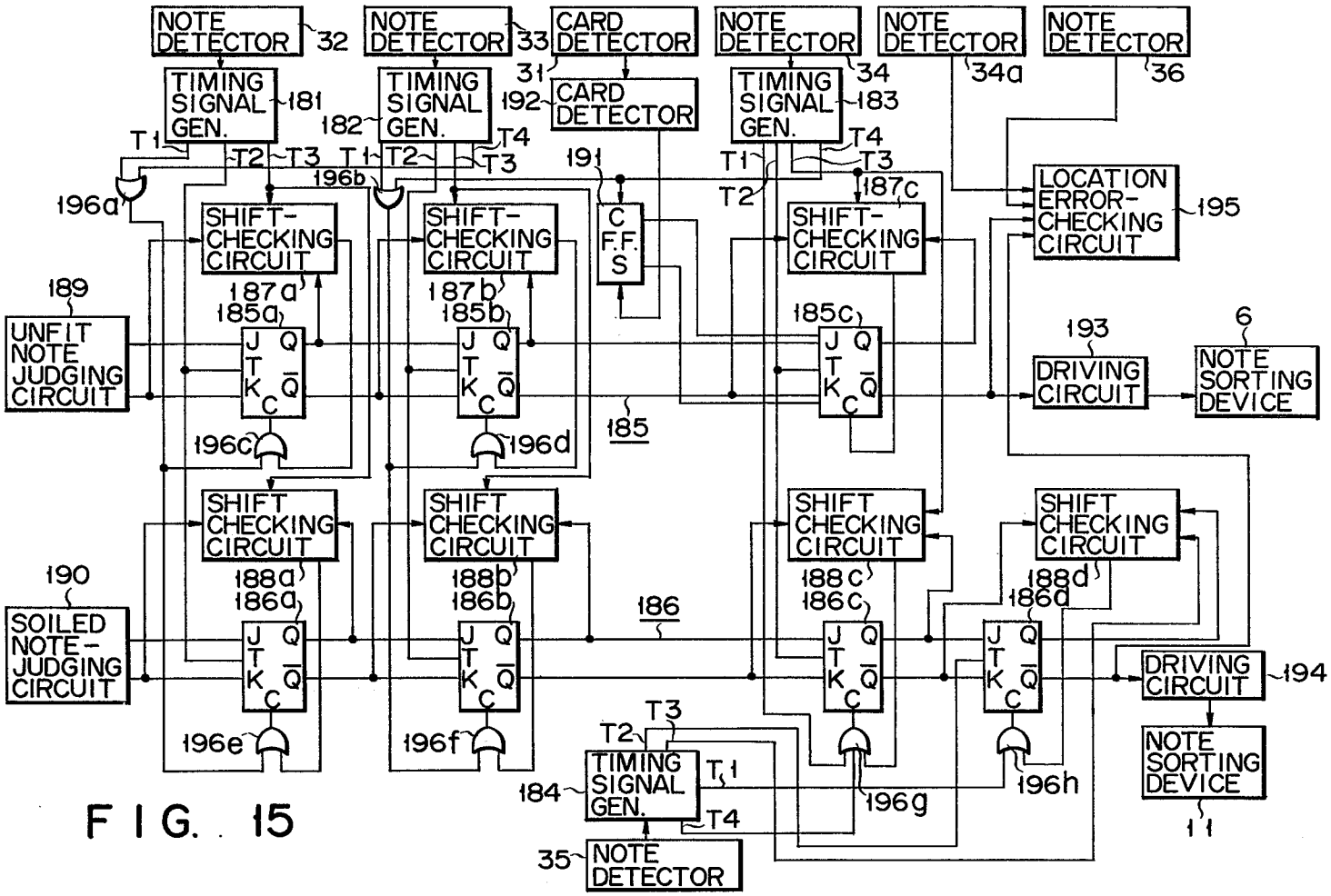
FIG. 15 is a block diagram of a thin sheet-shifting circuit.

There will not be described a note-locating circuit used with the sorting apparatus of this invention. The note-locating circuit arranged as shown in FIG. 15 shifts a signal denoting the result of decision given by the detecting device 5 of FIG. 1 in accordance with the transit of a note related to said decision, thereby controlling the operation of the note sorting devices 6, 11. Referential numerals 181, 182, 183, 184 are timing signal generators connected to the note detectors 32, 33, 34. These generators 181, 182, 183, 184 producing timing signals T1 to T4 which are supplied to J-K type flip-flop circuits (wherein after referred to as FF circuits (185*a*, 185*b*, 185*c* and 186*a*, 186*b*, 186*c*, 186*d* constituting shift registers 185, 186, as well as to the corresponding shift-checking circuits, 187*a*, 187*b*, 187*c* and 188*a*, 188*b*, 188*c*, 188*d*. Referential numeral 189 is an unfit note-judging circuit included in the detecting device 5 of FIG. 1. An output signal from the unfit note-judging circuit 189 is supplied to the input terminal of the shift register 185, namely, the J and K input terminals of the FF circuit 185*a*. Referential numeral 190 is a soiled note-judging circuit included in the detecting device 5. An output signal from the soiled note-judging circuit 190 is delivered to the input terminal of the shift register 186, namely, the J and K input terminals of the FF circuit 186*a*.

The unfit note-judging circuit 189 sets the FF circuit 185*a* at a state of "1" where an incoming note is not judged unfit. When the forward end of a note touches the note detector 32, the timing signal generator 181 sends forth a timing signal T1, which clears the FF circuit 186*a* of the shift register 186. An output signal delivered from the unfit note-judging circuit 189 upon receipt of a timing signal T2 is supplied in the FF circuit 185*a* of the shift register 185. Upon receipt of a timing signal T3, the checking circuit 187*a* examines whether the output signal from the unfit note-judging circuit 189 was surely stored in the FF circuit 185*a*. Where said examination proves the presence of a difference between the above-mentioned output signal from the unfit note-judging circuit 189 and the stored form thereof, then the shift register 185 is cleared. A timing signal T4 clears an FF circuit which has fully shifted a signal stored therein, namely, the preceding FF circuit. When the forward end of a traveling note reaches the note detector 33, the timing signal generator 182 similarly gives forth timing signals T1 to T4. As the result, data stored in the FF circuit 185*a* included in the shift register 185 is shifted to the FF circuit 185*b* thereof. Upon receipt of a timing signal T4, the data stored in the preceding FF circuit 185*a* is cleared.

Referential numeral 191 is an FF circuit stored with a signal showing the presence or absence of a sorting card in the sorting apparatus. When the sorting card detector 31 detects a sorting card, the corresponding note-detecting circuit 192 generates a signal denoting said detection. This detection signal sets the FF circuit 191. When the FF circuit 191 is thus set, a signal of "0" is stored in the FF circuit 185*c*, regardless of whether data stored in the preceding FF circuit 185*b* is "1" or "0". The FF circuit 185*c* is set when the forward end of a traveling note reaches the note detector 34. The driving circuit 193 of the note-sorting device 6 is controlled according to the data stored in the FF circuit 185*c*. Namely, when the FF circuit 185*c* is stored with data of "0", the note-sorting device 6 is so controlled as to convey a note to the unfit note collector 29.

On the other hand, the soiled note-judging circuit 190 produces a signal of "1" when an incoming note is not judged to be soiled. When the forward end of a traveling note reaches the note detector 32, the FF circuit 186*a* of the shift register 186 is stored upon receipt of a timing signal T2 with a signal of "0" when said note is soiled and with a signal of "1" when said note is not soiled. Hereafter, data stored in the shift register 186 is successively shifted in the same manner as described above. When the FF circuit 186*d* is stored with data upon the arrival of the forward end of a traveling note at the note detector 35, then the driving circuit 194 of the note-sorting device 11 is controlled in accordance with the data stored in the FF circuit 186*d*. Namely, when the FF circuit 186*d* is stored with data of "0", then the note-sorting device 11 is so controlled as to deliver a note to the soiled note collector 14*a* (14*d*).

It will be noted that data of "0" written in the shift registers 185, 186 is treated as a significant signal. This treatment originates with consideration of the safety of a note during transit. If a signal of "1" shifted through the shift register happens to be extinguished, for example, by external noises, then a note not supported by any signal should be sorted into a collector representing a higher priority of rejection for the sake of safety. For example, if a note supported by a signal denoting a soiled condition should lose said signal, then the note would be erroneously taken into the unfit note collector 29.

Where the FF circuit 185*c* of the shift register 185 is stored with data of "0", namely, where the note-sorting device 6 is so operated as to carry a note to the unfit note collector 29, the location error-checking circuit 195 is actuated to detect the passage of any other note than an unfit one through the note detector 34*a*, thereby preventing the placement of said other note in the unfit note collector 29. The location error-checking circuit 195 is also connected to the note detector 36, thereby obstructing the passage of a soiled note to the normal note collectors 12*a*, 12*b*. Referential numerals 196*a* to 196*h* of FIG. 15 denote OR circuits.

Figure 16:
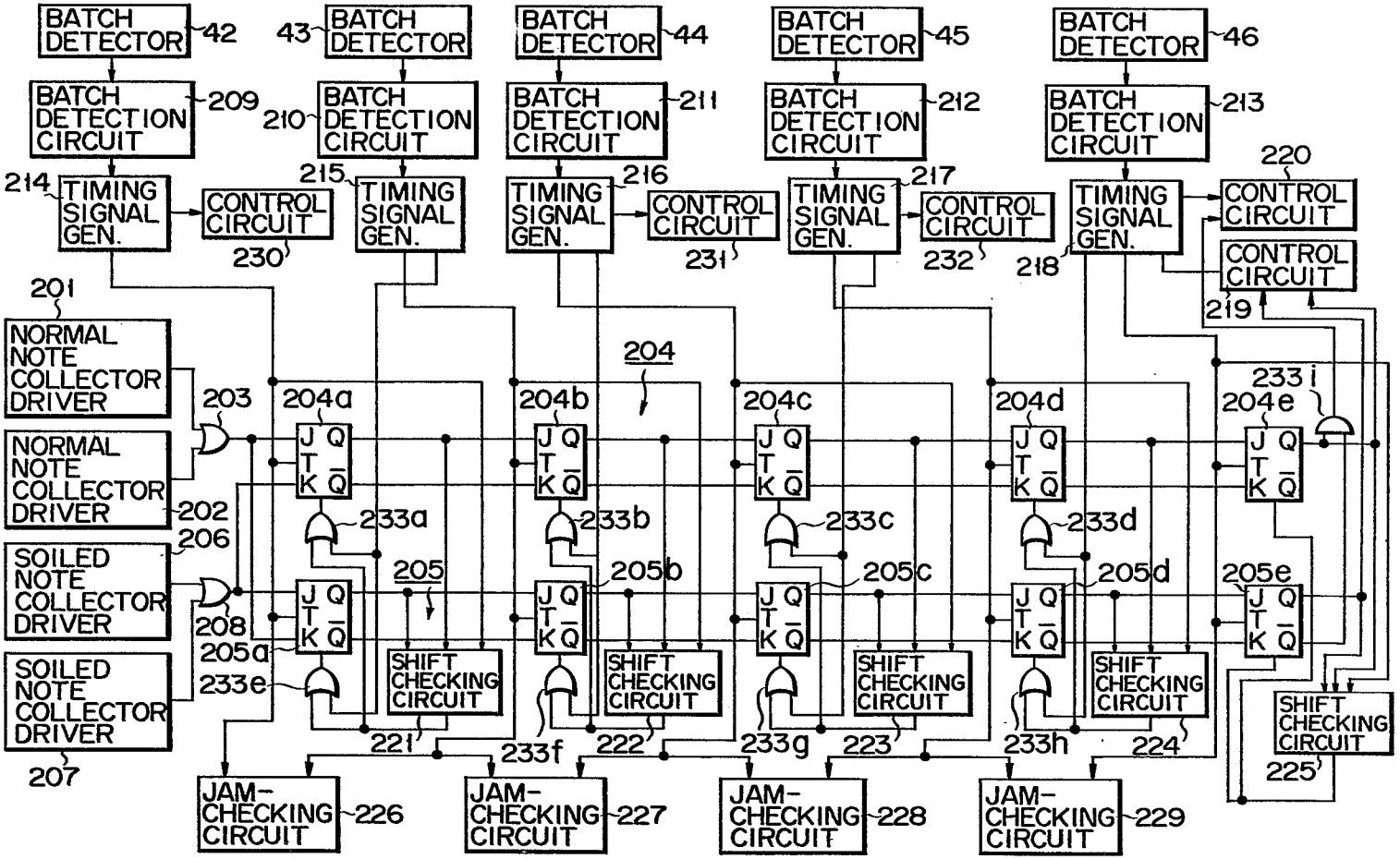
FIG. 16 is a block diagram of a sheet bundle-shifting circuit.

There will now be described a note batch-locating circuit used with the sorting apparatus of this invention. When the respective note collectors are operated, a signal denoting a batch of normal or soiled notes is shifted in the note batch-locating circuit. The printer 25 of FIG. 1 impresses a mark on a strap fastening a note batch according to the shifted signal, showing whether the batch consists of normal or soiled notes. The note batch-locating circuit controls the note batch-sorting device 26 of FIG. 1 to deliver the respective note batches to the corresponding note batch collectors. This note batch-locating circuit is arranged as shown in FIG. 16. Referential numeral 201 is the driving circuit of the first normal note collector 12*a* and 202 is the driving circuit of the second normal note collector 12*b*. Output signals from the driving circuits 201, 202 are supplied to shift registers 204, 205 through on OR circuit 203. The shift register 204 consists of J-K type flip-flop circuits (hereinafter referred to as "FF circuits") 204*a*, 204*b*, 204*c*, 204*d*, 204*e*. An output signal from the OR circuit 203 is delivered to the input terminal of the shift register 204, namely, the J input terminal of the first FF circuit 204*a*. The shift register 205 is formed of FF circuits 205*a*, 205*b*, 205*c*, 205*d*, 205*e*. An output signal from the OR circuit 203 is conducted to the input terminal of the shift register 205, namely, the K input terminal of the first FF circuit 205*a*. Referential numeral 206 is the driving circuit of the first soiled note collector 14*a*, and 207 is the driving circuit of the second soiled note collector 14*b*. Output signals from the driving circuits 206, 207 are supplied to the K input terminal of the first FF circuit 204*a* and the J input terminal of the first FF circuit 205*a* through an OR circuit 208. The note batch detectors 42, 43, 44, 45, 46 are connected to the corresponding timing signal generators 214, 215, 216, 217, 218 through note batch-detecting circuits, 209, 210, 211, 212, 213. Timing signals produced by the timing signal generators 214 to 218 are sent to the shift registers 204, 205.

Now let it be assumed that the first normal note collector 12*a* is operated by the driving circuit 201, a batch of 100 normal notes is brought to the note batch-conveying device 17, and said batch is delivered to the note batch detector 42. Then a detecting circuit 209 gives forth a signal to the timing signal generator 214, which in turn generates a timing signal. As the result, a signal of "1" is stored in the FF circuit 204*a*, and a signal of "0" in the FF circuit 205*a*. When a batch of normal notes is carried to the note batch detectors 43 to 46 in turn, then a signal of "1" is shifted through the FF circuits 204*b*, 204*c*, 204*d*, 204*e* in turn, and a signal of "0" is shifted through the FF circuits 205*b*, 205*c*, 205*d*, 205*e* in succession. When the FF circuits 204*e*, 205*e*, give forth output signals, a signal denoting a batch of normal notes is delivered to a printer control circuit 219 and the control circuit 220 of a note batch-sorting device 26. As the result, the printer 25 impresses a mark showing a normal note batch on a strap fastening said batch. This batch is stacked in the normal note batch collector by the note batch-sorting device 26.

On the other hand, when soiled notes are taken out of the soiled note collector 14*a* or 14*b*, a signal of "0" is stored in the FF circuit 204*a* and a signal of "1" in the FF circuit 205*a*. Thereafter, these stored signals are shifted through the corresponding FF circuits in the same manner as described above.

If, in case a note batch is brought, both FF circuits 204*a*, 205*a* are stored with a signal of "1" or "0", then the note batch misplacement-checking circuits 221, 222, 223, 224 are actuated to clear the associated FF circuits 204*a* to 204*e* and 205*a* to 205*e*. Since, under this condition, the above-mentioned batch is not supported by any signal, a mark showing a batch of soiled notes is finally impressed on the strap of said batch, which is consequently received in a soiled note collector. Where, as mentioned above, a note batch happens to lose its supporting signal, for example, by occurrence of noises, then said batch is handled as a batch of soiled notes.

A note batch is normally conducted in a substantially equal time through the intervening spaces of the respective note batch detectors 42 to 46. Where, therefore, difficulties arise, such as the failure of a note batch to be conveyed in a regular condition, then such event is detected by any of note batch jam-checking circuits 226, 227, 228, 229 provided in the intervening spaces of the respective note batch detectors 42 to 46. This checking is carried out as follows. Namely, measurement is made of the lengths of time required for successively conveyed batches to travel through the intervening spaces of the note batch detectors 42 – 46, where any of these traveling periods is found longer or shorter than the prescribed level, then the corresponding one of the above-mentioned note batch jam-checking circuits 226 to 229 judges that jamming took place among the conveyed note batches.

Though a batch of notes may be supplied from the note batch rearranging device 20 simply to set the note batch in good order, yet said batch is not supported in this case by any signal for the above-mentioned reason, and in consequence is handled as a batch of soiled notes, and delivered to the soiled note batch collector with a mark showing a soiled note batch impressed on a strap fastening said batch.

A timing signal given forth by the timing signal generator 214 is supplied to the control circuit 230 of the course-changing device 18 for control of the latter. A timing signal produced by the timing signal generator 216 is sent to the control circuit 231 to control the note batch rearranging device 20. A timing signal delivered by the timing signal generator 217 is carried to the control circuit 232 to control the strapping device 21. Referential numerals 233*a* to 233*i* of FIG. 16 denote OR circuits.

Figure 17:
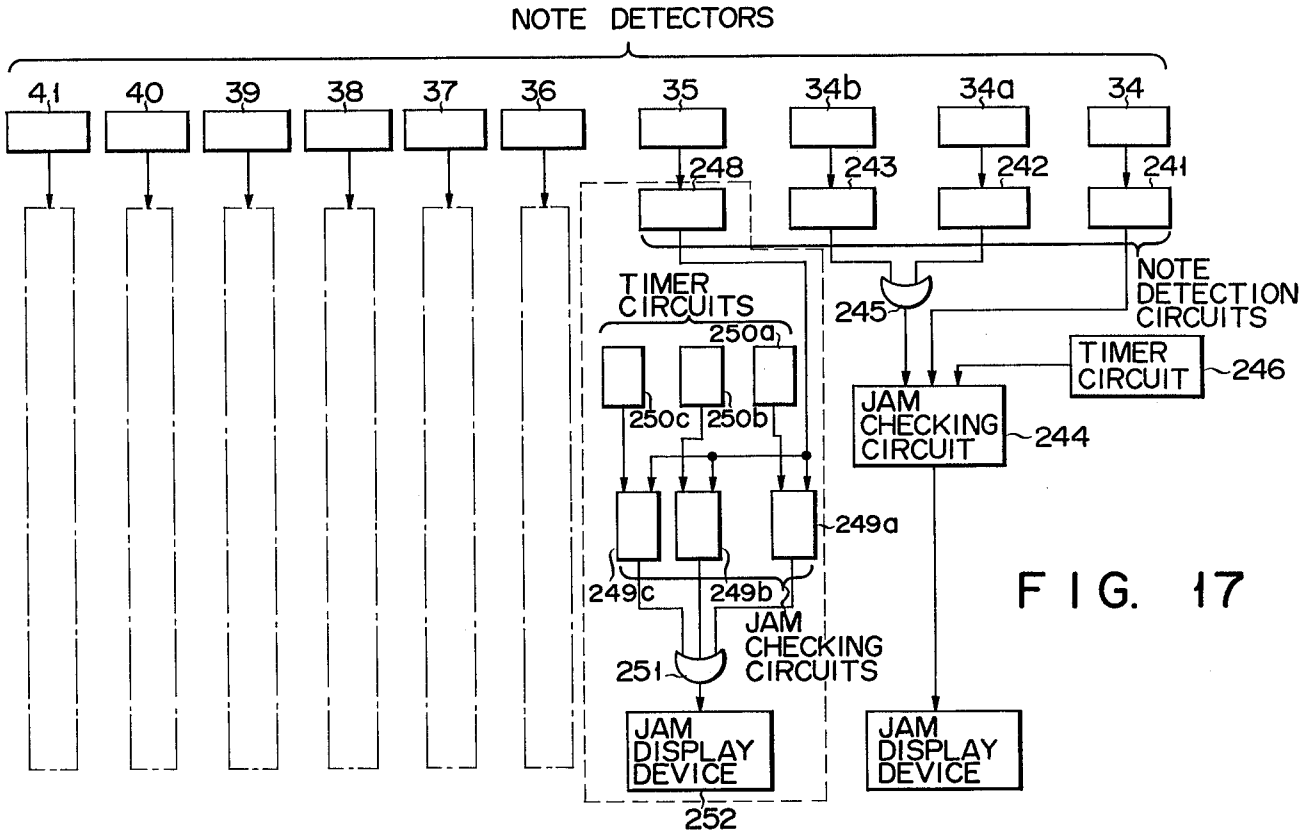
FIG. 17 is a block diagram of a circuit for detecting the jammed condition of thin sheets.

There will now be described a note jam-detecting circuit used with the sorting apparatus of this invention. This note jam-detecting circuit arranged as shown in FIG. 17 is intended quickly to detect any obstruction to the conveyance of a note which might otherwise result in the damage of the subject sorting apparatus. Referential numerals 241, 242, 243 denote note-detecting circuits connected to the note detectors 34, 34*a*, 34*b*. An output signal from the note detecting circuit 241 is supplied to a note jam-checking circuit 244 included in the note-sorting device 6. Output signals from the note detecting circuits 242, 243 are delivered to the note jam-checking circuit 244 through an OR circuit 245. The note jam-checking circuit 244 is supplied with an output signal from a time-setting circuit 246. The note jam-checking circuit 244 measures the time required for a note to travel from the note detector 34 to the note detector 34*a* or 34*b*. If the measured time is longer than the prescribed level, then the note jam-checking circuit 244 judges that the note was jammed with another note in the note-sorting device 6 and produces a signal, which is indicated by a note jam display device 247.

Referential numeral 248 is a note detecting circuit connected to the note detector 35. An output signal from the note detecting circuit 248 is carried to note jam-checking circuits 249*a*, 249*b*, 249*c*, which are supplied with output signals from time-setting circuits 250*a*, 250*b*, 250*c*. Output signals from the note jam-checking circuits 249*a*, 249*b*, 249*c* are delivered to a note jam display device 252 through an OR circuit 251. In the note-sorting device 11, the note jam-checking circuit 249*a* measures a length of time required for a note to pass through the note detector 35. If the measured time is longer than the prescribed level, then the note jam-checking circuit 249*a* judges that said note was jammed with another in the note-sorting device 11 or said note was brought to the sorting device 11 in close proximity to another, and gives forth a signal showing this event, which is indicated by a note jam display device 252. If a length of time required for a note to travel through the note detector 35 is determined by the note jam-checking circuit 249*b* to be shorter than the prescribed level, then said checking circuit 249*b* judges that the note was skewed or a foreign sheet was brought and produces a signal denoting this occurrence which is indicated by the note jam display device 252. Where the note jam-checking circuit 249*c* determines an interval between the passage of a note through the note detecter 35 and that of another therethrough to be shorter than the prescribed level, then said note jam-checking circuit 249*c* generates a signal showing this event which is indicated by the note jam display device 252.

The other note detectors 36 to 41 are also provided with circuits the same as those used with the note detector 35 to carry out these forms of checking and, in case of jamming, make indication to that effect.

There will now be described by reference to the flow chart of FIG. 18 the operation of the entire thin sheet-sorting apparatus of this invention. The various flows of this flow chart are classified as shown in the lower left portion of said chart. Throughout the following description, 1000 notes being sorted are grouped into 10 batches each fastened by a strap. The 10 batches are further bundled together by a broader band.

The sorting operation is carried out by the following steps listed substantially in the sequential order.

Figure 18A:
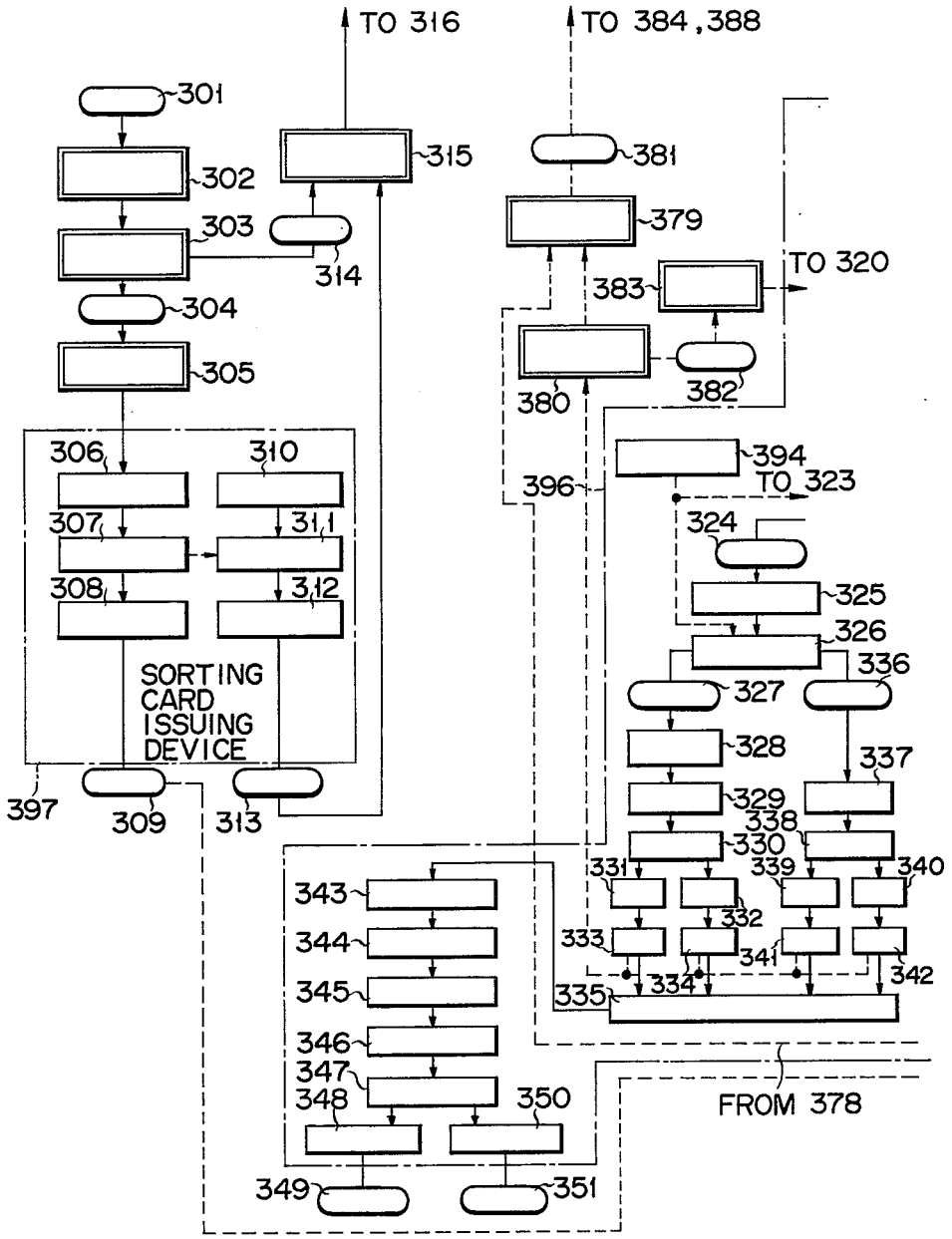
FIGS. 18A and 18B represent an entire flow chart showing the operation of the thin sheet-sorting apparatus of this invention.
Figure 18B:
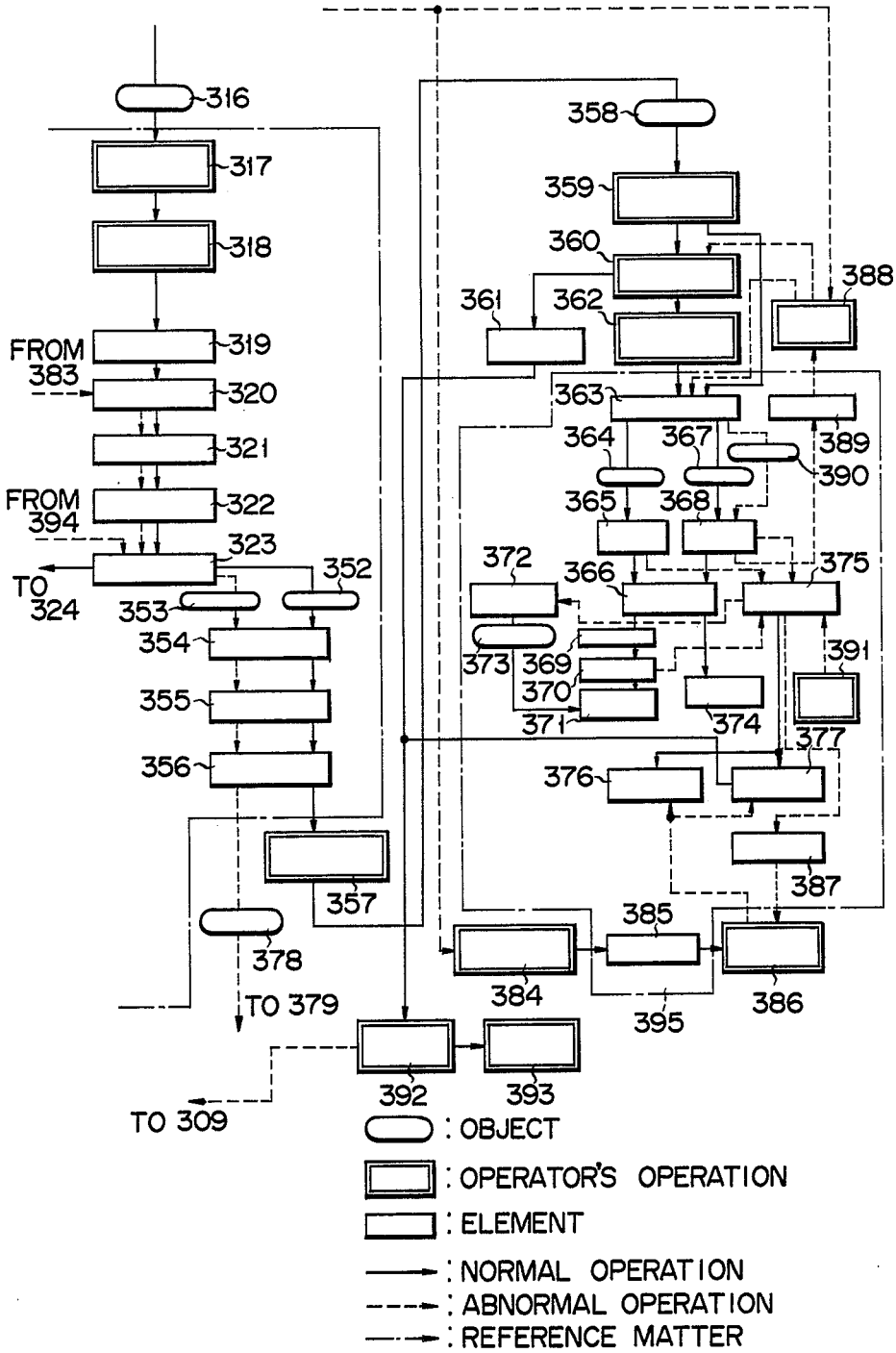

In FIG. 18, the contents of the blocks designated by the reference numerals are as follows:

| | |
|---|---|
| 301 | BANK NOTES TO BE SORTED |
| 302 | REMOVE THE BROAD BAND OF THE BUNDLE |
| 303 | REMOVE THE STRAP FROM THE 100-NOTE BATCH |
| 304 | STRAP |
| 305 | PUT THE STRAP IN THE INLET |
| 306 | INLET |
| 307 | PRINTER |
| 308 | STRAP RECEIVING SECTION |
| 309 | STRAP ROLL |
| 310 | SORTING CARD PAPER SUPPLY |
| 311 | MAGNETIC RECORDING DEVICE |
| 312 | OUTLET |
| 313 | SORTING CARDS |
| 314 | BANK NOTE BATCH |
| 315 | PUT TOGETHER BANK NOTES AND SORTING CARDS |
| 316 | BANK NOTES AND SORTING CARDS |
| 317 | PUT THE NOTES AND CARDS INTO A MAGAZINE |
| 318 | PLACE THE MAGAZINE IN THE FEED SECTION |
| 319 | FEED SECTION |
| 320 | PICKOUT DEVICE |
| 321 | DETECTING SECTION |
| 322 | SORTING CARD DETECTOR |
| 323 | SORTING DEVICE |
| 324 | NORMAL OR SOILED NOTE |
| 325 | COUNTER |
| 326 | NOTE-SORTING DEVICE |
| 327 | SOILED NOTE |
| 328 | STAMPING DEVICE |
| 329 | COUNTER |
| 330 | SOILED NOTE SORTING DEVICE |
| 331 | COUNTER |
| 332 | COUNTER |
| 333 | 2ND SOILED NOTE COLLECTOR |
| 334 | 1ST SOILED NOTE COLLECTOR |
| 335 | BATCH CONVEYING DEVICE |
| 336 | NORMAL NOTE |
| 337 | COUNTER |
| 338 | NORMAL NOTE SORTING DEVICE |
| 339 | COUNTER |
| 340 | COUNTER |
| 341 | 2ND NORMAL NOTE COLLECTOR |
| 342 | 1ST NORMAL NOTE COLLECTOR |
| 343 | COURSE CHANGING DEVICE |
| 344 | REARRANGING DEVICE |
| 345 | STRAPPING DEVICE |
| 346 | STAMPING DEVICE |
| 347 | BATCH SORTING DEVICE |
| 348 | SOILED NOTE BATCH COLLECTOR |
| 349 | SOILED NOTE BATCH |
| 350 | NORMAL NOTE BATCH COLLECTOR |
| 351 | NORMAL NOTE BATCH |
| 352 | SORTING CARD |
| 353 | ABNORMAL CARD |
| 354 | RECORDING DEVICE |
| 355 | READOUT DEVICE |

-continued

| | |
|---|---|
| 356 | COLLECTOR FOR SORTING CARD AND UNFIT NOTE |
| 357 | TAKE OUT SORTING CARD AND UNFIT NOTE |
| 358 | SORTING CARD AND UNFIT NOTE |
| 359 | INSERT THE SORTING CARD INTO SHEET INLET |
| 360 | CHECK THE UNFIT NOTE |
| 361 | PRESENCE OF THE UNFIT NOTE |
| 362 | THROW IN THE UNFIT NOTE ONE BY ONE |
| 363 | INLET |
| 364 | UNFIT NOTE |
| 365 | COUNTER |
| 366 | SORTING DEVICE |
| 367 | SORTING CARD |
| 368 | READOUT DEVICE |
| 369 | STAMPING DEVICE |
| 370 | COUNTER |
| 371 | BANK NOTE COLLECTOR |
| 372 | INTERVENING GROUPING SHEET SUPPLY SECTION |
| 373 | INTERVENING GROUPING SHEET |
| 374 | SORTING CARD COLLECTOR |
| 375 | ARITHMETIC OPERATION SECTION |
| 376 | ABSENCE OF EXCESS OR SHORTAGE |
| 377 | PRESENCE OF EXCESS OR SHORTAGE |
| 378 | ABNORMAL CARD |
| 379 | PUT TOGETHER BANK NOTE AND ABNORMAL CARD |
| 380 | ALL THE NOTES PUT IN THE COLLECTORS ARE TRANSFERRED TO THE RETURN NOTE BOX |
| 381 | BANK NOTE AND ABNORMAL CARD |
| 382 | ABNORMAL CARD |
| 383 | AFTER THE CLEARANCE OF JAM IS COMPLETED THE ABNORMAL CARD IS THROWN INTO THE PICKOUT DEVICE |
| 384 | COUNT THE BANK NOTES IN THE RETURN NOTE BOX BY MEANS OF A COUNTING DEVICE |
| 385 | COUNTING DEVICE |
| 386 | MANUAL COLLATION |
| 387 | COUNT INDICATION BEING COUNTED BY THE COUNTING DEVICE |
| 388 | THROW IN THE ABNORMAL CARD |
| 389 | INDICATION OF ABNORMALITY |
| 390 | ABNORMAL CARD |
| 391 | PUSH THE COLLATION SWITCH |
| 392 | PULL OUT THE CORRESPONDING STRAP BY REFERRING TO THE SORTING CARD |
| 393 | PRESCRIBED PROCEDURE |
| 394 | GRADING ORDER JUDGMENT SECTION |
| 395 | COUNT COLLATION DEVICE |
| 396 | SORTING APPARATUS |
| 397 | SORTING CARD ISSUING DEVICE |

1. A bundle of 10 note batches 301 is taken out ready for sorting with the broad band of the bundle removed.

2. A strap 304 fastening a 100-note batch included in the 10 batches is unfastened. The strap is put in the inlet 306 of the sorting card issuing device 397.

3. The sorting card-issuing device 397 digitally records a prescribed sequential number on the surface of the strap 304, showing the order which a batch of 100 notes now being sorted occupies among the 1000 notes. The strap is held on the takeup reel. A sorting card prepared by the sorting card-issuing device 397 is magnetically impressed with a number codified from the digital number recorded on the strap. Thereafter, the sorting card is drawn out of the sorting card outlet 312, thus completing the issue of the sorting card 313.

4. Unfastened 100 notes constituting one batch are received in a magazine 317, while the corresponding sorting card prepared by the sorting card issuing device 397 is placed at the bottom of the stacked notes.

5. All batches (10 batches in this embodiment) are received in the magazine while the corresponding sorting cards are placed at the bottom of the respective batches.

6. The magazine thus loaded is placed in the feeder 319.

7. The feeder 319 pushes the notes received in the magazine toward the pickout device 320.

8. The notes are drawn out of the feeder 319 one after another by the pickout device 320.

9. While traveling through the detecting device 321, a note taken out has its condition detected. The detecting device 321 judges the note to be superposed on another note, of a different denomination from those now being sorted, unfit, normal, or soiled, according to the detected condition.

10. A signal denoting the result of judgment by said detecting device 321 is generated for each note sorted in accordance with the prescribed grading order.

11. A signal showing the result of said judgment is shifted through a note locating circuit to determine the direction in which the note-sorting devices 323, 326 should be opened, causing a note to follow the course thus determined.

12. The sorting device 323 guides an unfit note (other than normal and soiled notes) to the unfit note collector 356.

13. When brought to the sorting device 326, the normal and soiled notes are separated from each other by a shifting signal.

14. Notes passing through the sorting device 326 are counted by the counter 329 (337).

15. Notes classified as normal by the sorting device 326 are counted by the counter 337 just before another sorting device 338. The first and second normal note collectors 341, 342 constituting the destination of notes classified by the sorting device 338 are alternately operated for each batch of 100 notes.

16. Normal notes being received in the normal note collector 341 (342) are counted at the inlet thereof, by the counter 339 (340).

17. Notes classified as soiled by the sorting device 326 are counted by the counter 329 just before another sorting device 330. The first and second soiled note collectors 333, 334 constituting the destination of notes classified by the sorting device 330 are alternately operated for each batch of 100 notes. If, in this case, notes are judged to be too much soiled for recirculation, a cancellation mark is stamped thereon.

18. The collector in which 100 normal or soiled notes have been received begins to be operated to discharge the notes. The note batch thus discharged is placed on the note batch-conveying device 335 and then forwarded to the course-changing device 343.

19. The batch brought to the course-changing device 343 has its course diverted 90° to be guided to the batch rearranging device 344.

20. When arriving at the batch rearranging device 344, a batch which happens to be ill stacked is rearranged into a proper rectangular form and then delivered to the strapping device 345.

21. A batch carried to the strapping device 345 is fastened by a strap. The strap is impressed with required items of information by the succeeding printer, as well as with a distinguishing mark showing a normal or soiled note batch upon receipt of a signal shifted through the note batch-shifting circuit.

22. Note batches whose straps are impressed with required data by the printer 346 are classified into normal and soiled ones by the note batch-sorting device 347 and received in the corresponding collectors.

23. Notes held in the feeder 319 are divided into batches of 100 by a sorting card placed at the bottom of each batch. When the sorting card is taken out into the sorting system, the sorting card detector 322 detects the presence of said card.

24. A sorting card thus detected is carried to the unfit note collector 356 by the sorting device 323.

25. The sorting card detector 322 unfailingly detects a sorting card, though it is sandwiched between the lowermost note of the immediately preceding batch and the uppermost note of the immediately succeeding batch due to the sorting card bearing a larger size than notes.

26. The recording device 354 upstream of the unfit note collector 356 is located at the point where the sorting card passes when a note preceding the sorting card is collected to the second soiled note collector **14*b*** and the count-checking of the counter and the calculation of the count number to be recorded is completed.

When a sorting card passes through the recording device 354, the number of those of 100 notes which should be received in the unfit note collector 356 is recorded on said sorting card. Where any abnormality occurs in any batch of 100 notes included, for example 10 batches fastening 1000 notes in total, the sequential number of said occurrence as counted from said 10 batches is recorded on the sorting card associated with said abnormal batch.

27. All data thus recorded on a sorting card are read out by the readout device 355 for confirmation. Thereafter, the sorting card is received in the unfit note collector 356.

28. Where jamming takes place in any sorting device or collector, or where the sorting device 323 carries out an erroneous location, the jam-detecting circuit detects such event and stops the conveyance of notes. Since in this case, the locality of such event is indicated, the notes remaining at said locality are manually removed or rearranged in good order. Thereafter, the removed notes are put in the unfit note collector 356, and the notes left on the conveying passageway are received in the corresponding collector or collectors. At this time, the pickout device 320 is kept at rest.

29. Where errors take place such as the sorting of notes exceeding or falling short of 100 notes constituting a batch (a doubt arises about the number of notes collected after sorting), wrong collation of counts (noncoincidence occurs between counts collated) or wrong location (a soiled note is classified as a normal note), then in the first case the notes received in a collector are manually removed, and in the latter two cases, any further supply of notes is stopped and the notes now traveling on the conveying passageway are put in a proper collector.

30. After the steps described under items (28) and (28), all the notes put in the collectors are transferred to the return note box 384.

31. Where any of the above-mentioned abnormalities arises, the corresponding indication is made. Information indicated (the sequential number of the occurrence of said abnormality as counted, for example, from 10 batches constituting 1000 notes) is recorded on a sorting card associated with said abnormal batch. This sorting card is put in the single sheet supply device 363 to be carried to the unfit note collector 356. The sorting card representing the abnormal batch is transferred from the unfit note collector 356 to the return box and placed in the uppermost part of said box. The number of manually counted notes which was not previously recorded on the sorting card of the abnormal batch is now manually recorded thereon.

32. Upon completion of the step of item (31), supply of notes is commenced again.

33. Where any error takes place in the recording of item (27), all the notes now traveling on the conveying device are put in a prescribed collector, with the supply of succeeding notes stopped. Thereafter, the sorting card bearing a wrong record is drawn out of the unfit note collector 356. The sorting card is inserted into the subject sorting apparatus through the single sheet supply device 363 to record data over again. Upon completion of this operation, supply of notes is resumed.

34. Where the unfit note collector 356 or return note box is filled up with notes, the pickout device 320 is stopped. When a fresh sorting card separating the batch of already sorted notes from the succeeding batch of notes is supplied to the sorting apparatus, then the unfit note collector 356 or return note box is moved away from the sorting apparatus. Where the pickout device 320 is brought to rest while some of the notes constituting a batch are already traveling, then the remaining notes and the corresponding sorting card are manually taken out of the feeder 319 to be put in the single sheet supply device 363. When the unfit note collector 356 or return note box has been detached from the sorting apparatus, then a separately provided empty unfit note collector or return note box is set in place.

35. The uppermost sorting card is taken out of the detached unfit note collector 356 to be manually supplied to the count-collating device 395 through the inlet 363. Thereafter, the notes stacked on the immediately succeeding sorting card are put in the inlet 363 one by one while judgment is made of the form of said notes, to determine whether the notes are of different denomination from the notes already noted, outdated or unfit type. The supply of said notes to the count-collating device 395 is stopped when the succeeding sorting card appears.

36. The information recorded on the sorted card supplied to the count-collating device 395 (such as the serial number of the sorting card, data showing the presence or absence of an abnormality, the counted number of notes, and the sequential number of the occurrence of the abnormality as counted, for example, from 10 batches included in 1000 notes) is all read out by the readout device 368. The sorting card thus handled is received in the card stacker 374. At this time, indication is made of the above-mentioned information read out by the readout device 368.

37. Notes supplied to the count-collating device 395 are counted by the counter 365, 370 and generally received in the collector 371 (FIG. 12).

38. A cancellation mark printer 369 is provided at the inlet to the collector 371. The printer 369 impresses a cancellation mark on the notes which should not be retained in the collector 371.

39. Notes received in the collector 371 are grouped by intervening grouping sheets of paper into a plurality of batches of 100 notes. Each batch of 100 notes is supplied to the strapping device of the subject sorting apparatus, and required items of information are impressed on a strap fastening the batch.

40. When the supply of notes to the count-collating device 395 after removal of the uppermost sorting card from the unfit note collector 356 is completed, the number of notes thus supplied can be determined from the counts made by the counters 365, 370. Collation is made of the number of 100 by carrying out an arithmetic operation from the number of notes determined by said counters 365, 370 and the number of notes read out from the information recorded on the sorting card. If said collation proves the notes thus counted neither to exceed nor fall short of the number of 100, then the conveying device is operated to receive the succeeding sorting card and the corresponding batch of notes. If said collation finds the counted number of notes constituting a given batch to exceed or fall short of 100, then indication is made of the total number of notes included in said batch. At this time, the subject sorting apparatus is stopped and the examination of the condition of notes constituting a batch represented by the succeeding batch is not carried out.

41. Where a given batch of notes is found to have a larger or smaller number than 100, then search is made from among a plurality of straps held on the takeup reel 309 as described under item (3) that strap which previously fastened said batch with reference to the serial number of the sorting card associated with said batch.

42. Where a note is determined to have a dubious form by the judgment mentioned under item (35), then the supply of succeeding notes is stopped, and in consequence the number of notes supplied to the count-collating device 48 becomes deficient.

43. The subject sorting apparatus stopped for the reasons given under items (41), (42) is designed to be released only the key kept under custody by a responsible person for the said sorting apparatus.

44. Where indication is made of the abnormality occurring in the batch of notes represented by the sorting card supplied, then the sequential number of the occurrence of the abnormality is recorded on the sorting card. Further, a separate abnormality card is issued with the same sequential number of said occurrence recorded thereon together with the number of abnormal notes received in the unfit note collector 356 which were counted by an exclusive counter. Therefore, the number of said abnormal notes can be found from the abnormality card even if not recorded on the sorting card.

45. The notes received in the unfit note collector 356 are supplied to the single sheet supply device 363 while being examined by naked eye. Since, at this time the remainder of the associated batch is not drawn out to the conveying device, the number of all the notes already carried by the conveying device falls, as naturally expected, short of the number of a whole batch. This shortage is indicated. The number of notes counted by the abovementioned exclusive counter and recorded on the abnormality card is again counted by an ordinary counter for collation. Where said collation proves coincidence between a sum of the sorted notes of a given batch plus the nonsorted remainder thereof and an estimated number of notes constituting a batch including the notes received in the unfit note collector 356 which were counted again by the ordinary counter, then said given batch is shown to have a regular number (for example, 100 ) of notes. If said collation discovers a noncoincidence between both values, then the batch is judged to exceed or fall short of the regular number of 100.

As mentioned above, this invention can unfailingly determine the excess or shortage of notes with respect to 100, sort normal and soiled notes, and further distinguish any of 10 batches of 100 noted included, for example, in 1000 notes in which an abnormality took place. Namely, this invention can easily discover any operator who handled an abnormal batch of notes, and also separately carry out the sorting of notes, the confirmation of the number of a batch, and the judgment of unfit notes such as notes of different denomination from those now being sorted and invalid notes. Therefore, the sorting apparatus of this invention can handle notes even in units of 100 quickly and continuously without losing effeciency, thereby attaining a prominent work-saving effect and reducing an operator's load.

The foregoing embodiment relates to the case where bank notes were handled. However, this invention is not limited thereto, but may be applied with the same effect to the handling of other thin sheets such as securities and bills. Further, this invention is not limited to the foregoing embodiment, but can obviously be practised in various modifications without changing the object and scope of the invention.

What is claimed is:

1. A thin sheet-sorting apparatus comprising a feeder for successively feeding a plurality of thin sheet batches comprising a prescribed number of thin sheets constituting a batch and a sorting card corresponding to each batch in the order mentioned; a device for taking out the thin sheets and the corresponding sorting cards in succession from the feeder; a detecting device for detecting the sorting cards and the thin sheets, said detecting device including means for classifying fit thin sheets, unfit thin sheets and sorting cards from the taken out thin sheets; means for separately stacking the thin sheets into a first group of fit thin sheets and a second group consisting of unfit thin sheets and sorting cards in accordance with the output of said detecting device, said separately stacking means comprising a first sorting gate for dividing the thin sheets and sorting cards into a first group consisting of fit thin sheets and a second group consisting of unfit thin sheets and sorting cards, a second sorting gate for dividing the fit thin sheets into normal and soiled thin sheets, a recording device for recording on each sorting card the total number of said fit thin sheets in the corresponding batch.

2. A thin sheet-sorting apparatus according to claim 1 further comprising means for counting the number of the first group of fit thin sheets of each batch, and means for recording the output of the counting means on each corresponding sorting card of each batch, so as to collate the items recorded on said sorting card with the total number of the sheets of said first and second groups.

3. A thin sheet-sorting apparatus according to claim 2 further comprising means for reading out the items recorded on each sorting card and the number of the sheets of the second group.

4. A thin sheet-sorting apparatus according to claim 3, wherein the separately stacking means comprises the first sorting gate for dividing the thin sheets into the first and second groups; a first-conveying passageway for further conducting the thin sheets divided by the first sorting gate into the first group and a second conveying passageway for further carrying the thin sheets classified as the second group by the first sorting gate; a first collector for receiving the thin sheets of the first group traveling through the first passageway; and a second collector for receiving the thin sheets of the second group carried through the second conveying passageway; and said reading out means includes second counting means for counting the number of thin sheets received in the second collector, whereby a checking operation whether the coincidence between the total number of the sheets of each batch set in said feeder and that of the sheets of the first and second groups was obtained or whether the total number of the sheets of the first and second groups coincides with the prescribed number of sheets of each batch or not can be made possible.

5. A thin sheet-sorting apparatus according to claim 2, wherein the detecting device comprises means for classifying normal and soiled bank notes together as the first group; and means for classifying as a third group a plurality of bank notes which were detected to be drawn out by the pickout device in a superposed or abnormally approaching state.

6. A thin sheet-sorting apparatus according to claim 5, wherein the superposition detecting means comprises a photoelectric conversion device consisting of a lamp and a photoelectric element so disposed as to face each other across a thin sheet conducted through a conveying passageway; and a level detector for detecting the level of an output signal from the photoelectric conversion device.

7. A thin sheet-sorting apparatus according to claim 5, wherein the abnormal approach-detecting means comprises first and second photoelectric conversion devices each formed of a lamp and a photoelectric element so positioned as to face each other across a thin sheet traveling through a conveying passageway; a first amplifier for amplifying an output pulse from the first photoelectric conversion device; a circuit for detecting the rear end of an output pulse from the first amplifier; a circuit for generating a checking signal according to an output signal from the pulse rear end detecting circuit; a circuit for determining the abnormal approach of two adjacent thin sheets from an output signal from the checking signal generator and an output signal from the first amplifier; a second amplifier for amplifying an output pulse from the second photoelectric conversion device; a circuit for detecting the forward end of an output pulse from the second amplifier; and a gate controller operated by an output signal from the forward pulse end detector which is given forth upon detection of the abnormal approach of two adjacent bank notes.

8. A thin sheet-sorting apparatus according to claim 5, wherein the soiled bank note detecting means comprises a photoelectric conversion device for producing an output signal corresponding to the intensity of light emitted from at least one specified region of the surface of a bank note; a comparator for comparing upper and lower level limits of an output signal from the photoelectric conversion device upon detection of a normal bank note with the level of an output signal from said photoelectric conversion device upon detection of a bank note estimated to have a soiled condition; and a circuit for generating an output signal indicating the soiled condition of a bank note thus examined when the level of an output signal from the photoelectric conversion device exceeds said upper limit or falls below said lower limit of the output for a normal bank note.

9. A thin sheet-sorting apparatus according to claim 1, which further includes a circuit for counting the numbers of thin sheets included in the respective divided groups.

10. A thin sheet-sorting apparatus according to claim 9, which further includes an arithmetic operation circuit for carrying out arithmetic operations with respect to values counted by the counting circuit in accordance with prescribed formulas.

11. A thin sheet-sorting apparatus according to claim 10, wherein the thin sheet-sorting means further includes a conveying passageway; a plurality of thin sheet detectors disposed on the conveying passageway; and a thin sheet shifting-circuit for generating an output signal denoting the position of a thin sheet traveling through the conveying passageway upon receipt of an output signal from any of the plural thin sheet position detectors.

12. A thin sheet-sorting apparatus according to claim 11, wherein the conveying passageway further includes a section for carrying a batch of thin sheets; and the sorting means further includes a plurality of thin sheet batch detectors arranged along the conveying passageway of a batch of thin sheets, and a thin sheet batch-shifting circuit for generating a signal indicating the position of a batch of thin sheets traveling on said conveying passageway upon receipt of an output signal from any of the thin sheet batch detectors.

13. A thin sheet-sorting apparatus comprising a feeder for successively feeding a plurality of thin sheet batches comprising a prescribed number of thin sheets constituting a batch and a sorting card corresponding to each batch in the order mentioned; a device for taking out the thin sheets and the corresponding cards in succession from the feeder; a detecting device for detecting the sorting cards and the thin sheets, said detecting device including means for classifying fit thin sheets, unfit thin sheets and sorting cards from the taken out thin sheets; means for separately stacking the thin sheets into a first group of fit thin sheets and a second group consisting of unfit thin sheets and sorting cards in accordance with the output of said detecting device, said separately stacking means comprising a first sorting gate for dividing the thin sheets and sorting cards into a first group consisting of fit thin sheets and a second group consisting of unfit thin sheets and sorting cards, a second sorting gate for dividing the fit thin sheets into normal and soiled thin sheets, a recording device for recording on each sorting card the total number of said fit thin sheets in the corresponding batch; the sorting card being obtained from a sorting card-issuing device which comprises a strap inlet through which a strap removed from a batch of thin sheets fastened thereby is inserted; conveying means for carrying the strap inserted; a strap detector for detecting the passage of the strap; a printer for digitally impressing required items of data on the incoming strap; first and second tape reels for supplying a pair of tapes to clamp therebetween the strap impressed with the required data; a takeup reel for winding the paired tapes clamping the printed strap for its storage; a magnetic tape reel for supplying a magnetic tape; a sorting card stock reel for supplying a sorting card stock being bonded with a magnetic tape; a cutter device for cutting up the bonded mass of the sorting card stock and magnetic tape in pieces having a prescribed length; a magnetic recording device for impressing the magnetic tape attached to each cut sorting card with the same data as recorded on the strap in a codified form; a sorting card detector; a cut sorting card-conveying passageway; a cut sorting card-discharging passageway.

14. A thin sheet-sorting apparatus comprising a feeder for successively feeding a plurality of thin sheet batches comprising a prescribed number of thin sheets constituting a batch and a sorting card corresponding to each batch in the order mentioned; a device for taking out the thin sheets and the corresponding cards in succession from the feeder; a detecting device for detecting the sorting cards and the thin sheets, said detecting device including means for classifying fit thin sheets, unfit thin sheets and sorting cards from the taken out thin sheets; means for separately stacking the thin sheets into a first group of fit thin sheets and a second group consisting of unfit thin sheets and sorting cards in accordance with the output of said detecting device, said separately stacking means comprising a first sorting gate for dividing the thin sheets and sorting cards into a first group consisting of fit thin sheets and a second group consisting of unfit thin sheets and sorting cards, a second sorting gate for dividing the fit thin sheets into normal and soiled thin sheets, a recording device for recording on each sorting card the total number of said fit thin sheets in the corresponding batch; a count-collating device consisting of an inlet through which sorting cards and bank notes are manually inserted; conveying means for carrying the sorting cards and bank notes thus inserted; a readout device for reading out data recorded on the sorting cards; a first counter for detecting and counting the incoming bank notes; a sorting device for separating the sorting cards from the bank notes; a sorting card stacker for collecting the sorting cards; a cancellation mark printer for impressing a cancellation mark on a bank note; a second counter device; a collector for receiving bank notes; a grouping paper roll for holding a grouping paper stock being used to divide the collected notes into prescribed units; a cutter device for cutting up the grouping paper stock in pieces having a required length; a conveying passageway for carrying the cut pieces of the grouping card stock.

15. A thin sheet-sorting apparatus comprising a feeder for successively feeding a plurality of thin sheet batches comprising a prescribed number of thin sheets constituting a batch and a sorting card corresponding to each batch in the order mentioned; a device for taking out the thin sheets and the corresponding sorting cards in succession from the feeder; a detecting device for detecting the sorting cards and the thin sheets, said detecting device including means for classifying fit thin sheets, unfit thin sheets and sorting cards from the taken out thin sheets; means for separately stacking the thin sheets into a first group of fit thin sheets and a second group consisting of unfit thin sheets and sorting cards in accordance with the output of said detecting device, said separately stacking means comprising a first sorting gate for dividing the thin sheets and sorting cards into a first group consisting of fit thin sheets and a second group consisting of unfit thin sheets and sorting cards, a second sorting gate for dividing the fit thin sheets into normal and soiled thin sheets, a recording device for recording on each sorting card the total number of said fit thin sheets in the corresponding batch; a circuit for counting the numbers of thin sheets included in the respective divided groups; an arithmetic operation circuit for carrying out arithmetic operations with respect to values counted by the counting circuit in accordance with prescribed formulas; the thin sheet-sorting means further comprising a conveying passageway; a plurality of thin sheet detectors disposed on the conveying passageway; a thin sheet shifting-circuit for generating an output signal denoting the position of a thin sheet traveling through the conveying passageway upon receipt of an output signal from any of the plural thin sheet position detectors; a jam-detecting circuit comprising means for detecting a length of time required for a thin sheet to travel through an interval between the adjacent ones of the plural thin sheet detectors and means for comparing the traveling time detected with a prescribed level and when said traveling time is shown to be longer than the prescribed level, indicating the jamming of thin sheets to take place between any two adjacent ones of the plural thin sheet detectors.

* * * * *